US007313932B2

(12) United States Patent
Ryohke et al.

(10) Patent No.: US 7,313,932 B2
(45) Date of Patent: Jan. 1, 2008

(54) WASHING MACHINE

(75) Inventors: Hideyuki Ryohke, Suita (JP); Nobuhiro Matsumoto, Nara (JP); Takahiko Hayashi, Nara (JP); Masahiro Satoh, Habikino (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 605 days.

(21) Appl. No.: 10/471,616

(22) PCT Filed: Mar. 11, 2002

(86) PCT No.: PCT/JP02/02266

§ 371 (c)(1),
(2), (4) Date: Sep. 12, 2003

(87) PCT Pub. No.: WO02/075034

PCT Pub. Date: Sep. 26, 2002

(65) Prior Publication Data

US 2005/0072194 A1 Apr. 7, 2005

(30) Foreign Application Priority Data

Mar. 15, 2001 (JP) ..... 2001-074255

(51) Int. Cl.
*D06F 39/00* (2006.01)

(52) U.S. Cl. ..... 68/3 R; 68/13 R

(58) Field of Classification Search ..... 68/3 R, 68/5 A, 12.02, 13 R
See application file for complete search history.

(56) References Cited

U.S. PATENT DOCUMENTS 2,468,550 A 4/1949 Fruth
2,584,943 A * 2/1952 Thomas ..... 239/458
3,209,560 A 10/1965 Shelton
3,688,527 A * 9/1972 Blustain ..... 68/3 SS
3,690,558 A * 9/1972 Tuttle ..... 239/127
4,483,571 A * 11/1984 Mishiro ..... 310/323.19
5,203,044 A 4/1993 Jung, Jr.
5,253,493 A 10/1993 Ohashi
5,381,574 A 1/1995 VonPless
5,869,932 A * 2/1999 Choi ..... 315/76
6,376,444 B1 4/2002 Hortel et al.
6,461,446 B1 10/2002 Satoh et al.
6,482,242 B2 * 11/2002 Yarmosky ..... 8/149.1
6,886,371 B2 * 5/2005 Arai et al. ..... 68/3 R
2002/0134117 A1 9/2002 Arai et al.

FOREIGN PATENT DOCUMENTS

CN 1271791 A 11/2000

(Continued)

*Primary Examiner*—Frankie L. Stinson
(74) *Attorney, Agent, or Firm*—Birch, Stewart, Kolasch & Birch, LLP

(57) ABSTRACT

A washing machine includes, a main body having a washing tub housed therein, a top plate laid on a top face of the main body and having a laundry entrance formed therein to permit laundry to be put therethrough in the washing tub, a lid covering the laundry entrance, a back panel laid on the top plate so as to be located in a rear side of the main body and having a connection pipe arranged therein for supplying water, an operation panel provided in a front portion of a top surface of the top plate, and a partial washing apparatus fitted to the back panel.

12 Claims, 15 Drawing Sheets

FOREIGN PATENT DOCUMENTS

| | | | | |
|---|---|---|---|---|
| JP | 45-29115 | U | | 11/1970 |
| JP | 49-111468 | A | | 10/1974 |
| JP | 57-122889 | A | | 7/1982 |
| JP | 59-203591 | | * | 11/1984 |
| JP | 63-991897 | | * | 5/1988 |
| JP | 01-5597 | A | | 1/1989 |
| JP | 64-5597 | | * | 1/1989 |
| JP | 1-213458 | | * | 8/1989 |
| JP | 1-223996 | | * | 9/1989 |
| JP | 1-223998 | | * | 9/1989 |
| JP | 1-223998 | A | | 9/1989 |
| JP | 2-5996 | A | | 1/1990 |
| JP | 2-52697 | A | | 2/1990 |
| JP | 2-550093 | | * | 2/1990 |
| JP | 2-71792 | A | | 3/1990 |
| JP | 3-60697 | A | | 3/1991 |
| JP | 9-234298 | A | | 9/1997 |
| JP | 10-5711 | | * | 1/1998 |
| JP | 10-5711 | A | | 1/1998 |
| JP | 10-128175 | | * | 5/1998 |
| JP | 10-128175 | A | | 5/1998 |
| JP | 11-267392 | A | | 10/1999 |
| JP | 2000-24362 | | * | 1/2000 |
| JP | 2000-61192 | A | | 2/2000 |
| JP | 2000-210492 | | * | 8/2000 |
| JP | 2000-210492 | A | | 8/2000 |
| JP | 2000-210493 | A | | 8/2000 |
| JP | 2000-308788 | A | | 11/2000 |
| JP | 2001-61682 | | * | 3/2001 |

* cited by examiner

WASHING MACHINE

BACKGROUND OF THE INVENTION

This application is the national phase under 35 U.S.C. § 371 of PCT International Application No. PCT/JP02/02266, which has an International filing date of Mar. 11, 2002, and which designated the United States of America.

1. Field of the Invention

The present invention relates to a washing machine for washing clothes and other articles of cloth.

2. Description of Related Art

With a washing machine (electric washing machine), washing is typically achieved by putting pieces of laundry in a washing tub and making them flow together with water having detergent dissolved in it (so as to form them into a whirling stream, or agitate them) inside the washing tub. Alternatively, washing is achieved by rotating the washing tub itself. In either way, the articles put in the washing tub are washed all together so that the effect of washing is exerted uniformly on every part of the laundry. However, heavily soiled parts of laundry, for example collars, cuffs, and stained parts, often cannot be cleaned satisfactorily with all-together washing as described above. In such cases, particularly dirty parts of laundry need to be washed separately by hand.

For this reason, attempts have been made to equip a washing machine with a partial washing apparatus for washing parts of laundry. An example is disclosed in Japanese Patent Application Laid-Open No. H2-5996. This publication discloses a washing machine incorporating a partial washing apparatus, which is composed of a rotary washing member, having brush members and protuberances provided around it, and a washing board so that an article of laundry is nipped between the rotary washing member and the washing board and is thereby washed through brushing and rubbing.

Another example of a washing machine equipped with a partial washing apparatus is disclosed in Japanese Patent Application Laid-Open 2000-61192. This publication discloses a washing machine that employs a supersonic washing apparatus as the partial washing apparatus. Now, the structure of a washing machine of the type disclosed in this publication will be described with reference to FIGS. 21 and 22.

The washing machine 1 shown in FIG. 21 is of a full automatic type, and has a main unit 2, which is structured as follows. The main unit 2 has an outer casing 10. The outer casing 10 has the shape of a rectangular parallelepiped, and is formed of metal or synthetic resin. The outer casing 10 is open at the top and bottom. A top plate 11 formed of synthetic resin is laid over the top opening of the outer casing 10, and is fixed to the outer casing 10 with screws. In FIG. 21, the front face and rear face of the main unit 2 are shown on the left and right, respectively, of the drawing. A back panel 12 formed of synthetic resin is laid on the top surface of the top plate 11, in a rear portion thereof, and is fixed to the top plate 11 with screws. A base 13 formed of synthetic resin is laid under the bottom opening of the outer casing 10, and is fixed to the outer casing 10 with screws. In the four corners of the base 13 are formed, integrally therewith, feet 14 for supporting the main unit 2 on a floor. It is to be noted that none of the screws mentioned thus far are shown in the figure.

In the top plate 11 is formed a laundry entrance 15 through which laundry is put in the washing tub as described later. The laundry entrance 15 is fitted with a lid 16 that covers it from above. The lid 16 is divided into a front lid **16*a* and a rear lid 16*b*, which are hinged together with a shaft 17 so as to be foldable in two. The rear lid 16*b* is hinged to the top plate 11 with a shaft 18. The shaft 18 is provided horizontally in front of the back panel 12 so as to extend perpendicularly to the plane of the figure. Thus, the rear lid 16*b* is rotatable in a vertical plane. The shafts 17 and 18 are parallel to each other. Thus, the front lid 16*a* also is rotatable in a vertical plane relative to the rear lid 16*b*. Making the lid 16 foldable in two in this way helps reduce the rotation radius thereof, and thus permits the lid 16 to be opened even when an obstacle is placed above the washing machine 1** close thereto.

Inside the outer casing 10, a water tub 20 and a washing tub 30 are arranged. The water tub 20 and the washing tub 30 both have the shape of a cylindrical cup, open at the top. The water tub 20 and the washing tub 30 are arranged concentrically with their axes vertical and with the water tub 20 outside and the washing tub 30 inside. The water tub 20 is suspended by a suspension mechanism 21. The suspension mechanism 21 is composed of suspension members arranged in four positions around the water tub 20 so as to link a bottom portion thereof to each inner corner of the outer casing 10, and supports the water tub 20 in such a way that it is swingable in a horizontal plane.

The washing tub 30 has a peripheral wall that is gently tapered so as to be increasingly wide open upward. Except for a plurality of water discharge openings 31 formed in a circular arrangement in its topmost portion, the peripheral wall has no opening that permits liquid through. Around the rim of the top opening of the washing tub 30, a ring-shaped balancer 32 is fitted. The balancer 32 serves to reduce vibration when the washing tub 30 is rotated at high speed when laundry is dewatered. On the inner bottom surface of the washing tub 30, a pulsator 33 is arranged. The pulsator 33 serves to produce a flow of washing fluid or rinsing water inside the washing tub 30.

On the outer bottom surface of the water tub 20, a drive unit 40 is mounted. The drive unit 40 includes a motor 41, a clutch mechanism 42, and a brake mechanism 43. From the center of the drive unit 40, a washing tub shaft 44 and a pulsator shaft 45 protrude upward. The washing tub shaft 44 and the pulsator shaft 45 form a double shaft, with the washing tub shaft 44 outside and the pulsator shaft 45 inside. The washing tub shaft 44 penetrates the water tub 20, and couples to the washing tub 30, thereby supporting it. The pulsator shaft 45 penetrates the washing tub 30 as well, and couples to the pulsator 33, thereby supporting it. The gap between the washing tub shaft 44 and the water tub 20 and the gap between the pulsator shaft 45 and the washing tub 30 are sealed with sealing members to prevent leakage of water.

In the space between the top plate 11 and the back panel 12 is arranged a water feed valve 50 that is opened and closed electromagnetically. The water feed valve 50 has a connection pipe 51 that penetrates the back panel 12 and protrudes upward. The connection pipe 51 connects to a water feed hose (not shown) through which clean water, such as tap water, is supplied. From the water feed valve 50, a water feed nozzle 52 extends frontward. The tip of the water feed nozzle 52 reaches above the washing tub 30. Though not shown, a mixing device for mixing detergent, fabric softener, or the like with water is provided in the water passage from the water feed valve 50 to the tip of the water feed nozzle 52. To the bottom of the water tub 20, an air trap 53 is coupled. From the air trap 53, a connecting pipe 54 extends upward. To the top end of the connecting pipe 54, a water level switch 55 is connected.

To permit the water in the water tub 20 and in the washing tub 30 to be drained out of the main unit 2, a drain hose 60 is provided. The drain hose 60 is connected, immediately below the water tub 20, to branch pipes 60*a* and 60*b*, of which one 60*a* connects to the bottom of the water tub 20 in a portion near the periphery thereof and the other 60*b* connects thereto in a portion near the center thereof. To the inner bottom surface of the water tub 20, a ring-shaped partition wall 61 is fixed so as to enclose the portion of the water tub 20 where the branch pipe 60*b* is connected. On top of the partition wall 61, a ring-shaped sealing member 62 is fitted. The sealing member 62 is kept in contact with the outer peripheral surface of a disk 63 fixed to the outer bottom surface of the washing tub 30, forming a separate drain space 64 between the water tub 20 and the washing tub 30. The drain space 64 communicates with the inside of the washing tub 30 through a drain outlet 65 formed in the bottom of the washing tub 30. The air trap 53 connects to the drain space 64. The branch pipe 60*b* is provided with a drain valve 66 that is opened and closed electromagnetically.

In a front portion of the main unit 2, a partial washing apparatus 70 is provided. The partial washing apparatus 70 is provided with an arm 72 that rotates in a horizontal plane about a vertical shaft 71 provided on the bottom surface of the top plate 11. To the tip of the arm 72, a supersonic washer 73 is fitted. The supersonic washer 73 has a supersonic vibration horn. When not in use, the partial washing apparatus 70 is retracted to beneath the top plate 11, as indicated by broken lines in FIG. 22. When in use, the partial washing apparatus 70 is pulled out, as indicated by solid lines, so that the supersonic washer 73 is located around the center of the laundry entrance 15. Inside the arm 72 are laid a water feed tube and electric leads for feeding cleaning fluid and electric power, respectively, to the supersonic washer 73. The supersonic washer 73 has a gap 74 formed therein to permit an article of laundry to be passed therethrough. The washing machine is intended for use in a household, and therefore the supersonic washer 73 is designed to offer a high degree of safety.

Under the top plate 11, a controller 80 is arranged. The controller 80 feeds commands to the drive unit 40, the water feed valve 50, and the drain valve 66. The controller 80 also feeds display commands to a display (not shown) provided on the top surface of the top plate 11. The controller 80 includes a circuit for controlling the supersonic washer 73.

The washing machine 1 described above operates as follows. With the partial washing apparatus 70 retracted beneath the top plate 11, articles of laundry are put in the washing tub 30 through the laundry entrance 15, and the lid 16 is closed. Through operation of operation buttons (not shown) arranged on the top surface of the main unit 2, the desired course of washing is selected, and the starting of operation is commanded. Thus, the washing machine 1 starts operating automatically. First, the amount of laundry is determined. Then, water is supplied to the washing tub 30 through the water feed nozzle 52. Here, the drain valve 66 is closed. The water level switch 55 monitors the level of water in the washing tub 30. When the water level switch 55 detects that an amount of water commensurate with the amount of laundry has pooled in the washing tub 30, the water feed valve 50 is closed. Here, the water is mixed with detergent before it is discharged out of the water feed nozzle 52, and thus the water pooled in the washing tub 30 is washing fluid having the detergent dissolved in it.

Next, a washing process is started. In the washing process, the motor 41 rotates the pulsator 33. As the pulsator 33 rotates, the washing fluid flows, washing the laundry. Here, the brake mechanism 43 applies a brake to the washing tub shaft 44. Thus, the washing tub 30 does not rotate together with the washing fluid and the laundry. A predetermined period thereafter, the motor 41 stops, and thus the pulsator 33 stops rotating. In addition, the drain valve 66 opens. The washing fluid in the washing tub 30 is drained through the drain space 64. When, a predetermined period thereafter, the most of the washing fluid has drained out of the laundry, the clutch mechanism 42 is switched so that now the motor 41 rotates the washing tub shaft 44. This causes the washing tub 30 to rotate at high speed for dewatering. Here, the pulsator 33 rotates together with the washing tub 30.

As the washing tub 30 rotates at high speed, the laundry is pressed against the inner peripheral wall of the washing tub 30 by centrifugal force. The washing fluid contained in the laundry also gathers on the inner surface of the peripheral wall. Since the washing tub 30 is tapered so as to be increasingly wide open upward as described earlier, the washing fluid acted on by the centrifugal force rises along the inner surface of the washing tub 30. When the washing fluid reaches the top end of the washing tub 30, it is discharged through the discharge openings 31. After being discharged through the discharge openings 31, the washing fluid hits the inner surface of the water tub 20, and flows down, along the inner surface of the water tub 20, to a bottom portion of the water tub 20. The washing fluid is then drained out of the main unit 2 through the branch pipe 60*a* and then the drain hose 60.

After the laundry is dewatered sufficiently, the drain valve 66 is closed. Then, water for rinsing is supplied through the water feed nozzle 52. When a predetermined amount of rinsing water has pooled in the washing tub 30, the pulsator 33 is rotated to agitate the rinsing water and the laundry. This causes the dirt and detergent components left in the laundry to be released into the rinsing water. A predetermined period thereafter, the pulsator 33 is stopped. Then, the drain valve 66 is opened to discharge the rinsing water. Then, the washing tub 30 is rotated for dewatering so that water is shaken out of the laundry. Rinsing and dewatering processes like these are repeated a predetermined number of times. When the last dewatering process is complete, a whole washing procedure is complete.

In the above descriptions, it is assumed that rinsing is achieved by "pooled-water rinsing," i.e. rinsing performed with rinsing water pooled in the washing tub 30. However, it is also possible to achieve rinsing by "shower rinsing," i.e. rinsing performed while the washing tub 30 is rotated at low speed with water kept supplied through the water feed nozzle 52. Whether to adopt pooled-water rinsing, shower rinsing, or both is determined according to the selected course of washing and the amount of laundry.

In cases where dirt persists after washing, or where there are stubborn stains that are unlikely to be removed through an ordinary course of washing, the partial washing apparatus 70 is used to wash particularly dirty parts of laundry. Specifically, the partial washing apparatus 70 is pulled out from the non-use position indicated by the broken lines in FIG. 22 to the use position indicated by the solid lines. With the partial washing apparatus 70 in this position, the supersonic washer 73 is driven while the cleaning fluid is supplied. In this state, a dirty part of laundry is passed through the gap 74, so that this part is cleaned by the synergistic effect of supersonic waves and cleaning fluid.

After sufficient partial washing is performed, the laundry is put in the washing tub 30. Then, if a washing process had been finished before the partial washing, rinsing and dewatering processes are performed, or, if a washing process has not been finished yet, a washing procedure is started with a washing process.

The washing machines disclosed in Japanese Patent Application Laid-Open No. H2-5996 and Japanese Patent Application Laid-Open 2000-61192 mentioned above both incorporate a partial washing apparatus inside the main body of the washing machine. This poses the following problems. First, the partial washing apparatus is located in a position lower than the top face of the washing machine (specifically about 750 to 800 mm above the floor surface). This forces the user, when using the partial washing apparatus, into a slightly stooped posture, depending on his or her height. This puts a heavy burden on the user's body, producing severe fatigue. This can be solved by bringing the partial washing apparatus to a higher position. However, this increases the height of the main body of the washing machine, bringing the laundry entrance to a higher position, and thus makes it difficult to put in and take out laundry. Second, the brush and the supersonic vibration horn for achieving partial washing are not guarded. This poses a risk of the user's hand touching those components. If the user's hand touches the brush, it is scarred, and may even be pinched between the brush and the washing board. If the user's hand touches the supersonic vibration horn, it aches, and its cartilaginous tissue may be affected adversely by the vibration, which is in such a frequency range as to reach deep into the human body.

SUMMARY OF THE INVENTION

According to the present invention, in a washing machine, a partial washing apparatus is fitted on an outer surface of a main unit having a washing tub housed therein. With this structure, since a partial washing apparatus is fitted on an outer surface of a main unit having a washing tub housed therein, the partial washing apparatus can be arranged at a height convenient for partial washing irrespective of the height of the main unit. Thus, the user is not forced into a stooped posture. Moreover, the height of the main unit may be about equal to that of an ordinary washing machine. Thus, laundry can be put in and taken out without difficulty. Moreover, partial washing is performed not in a narrow space inside a laundry entrance but in a wide space outside the main unit. This permits easy and efficient washing, and also permits easy maintenance and repair of the partial washing machine.

In the washing machine structured as described above, the partial washing apparatus is movable between an use position where it is placed when in use and a non-use position where it is placed when not in use. With this structure, the partial washing apparatus, when not in use, can be moved to the non-use position so as not to hinder the loading and unloading of laundry into and out of the washing tub.

In the washing machine structured as described above, a laundry entrance is formed in the top face of the main unit, and the washing portion of the partial washing apparatus is, when the partial washing apparatus is in the use position, located in a position in which the washing portion faces the laundry entrance and, when the partial washing apparatus is in the non-use position, retracted from the position in which the washing portion faces the laundry entrance. With this structure, cleaning fluid that drips down from the partial washing apparatus when it is used can be collected in the washing tub.

According to the present invention, a washing machine is provided with a partial washing apparatus that is movable between an use position in which it is placed when in use and a non-use position in which it is placed when not in use, and the use position is so located that fluid dripping down from a piece of laundry being treated by partial washing is discharged into a drain path. With this structure, the fluid used to treat a piece of laundry by partial washing is discharged directly into the drain path. This eliminates the risk that the fluid used in partial washing mixes with and thereby spoils the cleanliness of the water in the washing tub.

According to the present invention, a washing machine is provided with a partial washing apparatus that is movable between an use position in which it is placed when in use and a non-use position in which it is placed when not in use, and position detecting means for detecting the position of the partial washing apparatus. With this structure, the position of the partial washing apparatus is detected so that no operation of the washing machine is possible that is inappropriate if performed with the partial washing apparatus in its current position.

In the washing machine structured as described above, a laundry entrance through which laundry is put in a washing tub is formed in the top face of a main unit, a lid for openably closing the laundry entrance is provided, locking means for locking the lid is provided, and the locking means is controlled according to the position of the partial washing apparatus as detected by the position detecting means. With this structure, when the partial washing apparatus is located in a position in which it hinders the opening and closing of the lid, the lid is locked in a closed state. This helps prevent noise resulting from the lid colliding with the partial washing apparatus, and helps prevent damage to the lid, or the partial washing apparatus, or both.

In the washing machine structured as described above, the operation of the partial washing apparatus is controlled according to the position of the partial washing apparatus as detected by the position detecting means. With this structure, it never occurs that the operation of the partial washing apparatus is started with the partial washing apparatus placed elsewhere than in the use position. This helps prevent electric power and cleaning fluid from being wasted, and also helps prevent the outer surface of the main unit from becoming wet with the cleaning fluid.

In the washing machine structured as described above, a laundry entrance through which to put laundry in a washing tub is formed in the top face of a main unit, a lid for openably closing the laundry entrance is provided, locking means for locking the lid is provided, and the locking means is controlled according to the position of the partial washing apparatus as detected by the position detecting means. With this structure, when the partial washing apparatus is located in a position in which it hinders the opening and closing of the lid, the lid is locked in a closed state. This helps prevent noise resulting from the lid colliding with the partial washing apparatus, and helps prevent damage to the lid, or the partial washing apparatus, or both.

In the washing machine structured as described above, the lid is hinged to the main unit so as to be rotatable in a vertical plane, and a gate opening through which the partial washing apparatus is let to pass is formed in the lid so that the lid can be opened with the washing portion of the partial washing apparatus located in the position in which it faces the laundry entrance. With this structure, as long as partial washing is performed with the lid open and with the partial washing apparatus protruding above the laundry entrance, the water that splashes from the partial washing apparatus is collected in the washing tub, without making the floor wet.

In the washing machine structured as described above, the lid can be opened with the washing portion of the partial washing apparatus located in a position in which the washing portion faces the laundry entrance. With this structure, even with the washing portion of the partial washing apparatus located where it faces the laundry entrance, the lid can be opened and closed without bothering to move the partial washing apparatus to the non-use position.

In the washing machine structured as described above, the lid is hinged to the main unit so as to be rotatable in a vertical plane, and a gate opening through which to let the partial washing apparatus pass is formed in the lid so that the lid can be opened with the washing portion of the partial washing apparatus located in the position in which it faces the laundry entrance. With this structure, as long as partial washing is performed with the lid open and with the partial washing apparatus protruding above the laundry entrance, the water that splashes from the partial washing apparatus is collected in the washing tub, without making the floor wet.

In the washing machine structured as described above, the partial washing apparatus is combined with a tray for sustaining a piece of laundry. With this structure, there is no need to sustain a piece of laundry with the hands when it is treated by partial washing. The tray makes the user's finger less likely to touch the washing portion, and thus helps improve safety.

In the washing machine structured as described above, the partial washing apparatus is combined with a tray for sustaining a piece of laundry, and the tray is so shaped as to partially or completely close the gate opening. With this structure, there is no need to sustain a piece of laundry with the hands when it is treated by partial washing, and this is achieved without sacrificing the lid's function to close the laundry entrance. The tray makes the user's finger less likely to touch the washing portion, and thus helps improve safety.

In the washing machine structured as described above, tray detecting means for detecting the presence of the tray is provided. With this structure, it never occurs that the washing machine operates without the tray placed in position.

In the washing machine structured as described above, the tray detecting means is provided in the partial washing apparatus. With this structure, the tray detecting means is located in the position most suitable for the detection of the tray.

In the washing machine structured as described above, the operation of the partial washing apparatus is controlled according to the result of detection by the tray detecting means. With this structure, the user is safe from the risk of starting partial washing without the tray.

In the washing machine structured as described above, a laundry entrance through which laundry is put in the washing tub is formed in the top face of the main unit, and a lid for closing the laundry entrance is provided. Here, the lid is so designed that, when the partial washing apparatus is in the non-use position, as the lid is opened and closed, the tray is opened and closed together, and, when the partial washing apparatus is in the use position, the lid alone is opened and closed. With this structure, it never occurs that, even though the partial washing apparatus is in the non-use position and the lid is open, the tray alone is left above the laundry entrance and hinders the loading of laundry.

In the washing machine structured as described above, the drain outlet is open toward or communicates with a drain path leading to outside the washing machine. With this structure, the cleaning fluid used in partial washing can be quickly drained out of the washing machine so as not to stay inside it.

In the washing machine structured as described above, a laundry entrance through which to put laundry in the washing tub is formed in the top face of the main unit, and a lid for closing the laundry entrance is provided. Here, the lid is so designed that, when the partial washing apparatus is in the non-use position, as the lid is opened and closed, the tray is opened and closed together, and, when the partial washing apparatus is in the use position, the lid alone is opened and closed. With this structure, it never occurs that, even though the partial washing apparatus is in the non-use position and the lid is open, the tray alone is left above the laundry entrance and hinders the loading of laundry.

In the washing machine structured as described above, locking means for keeping the partial washing apparatus in the non-use or use position is provided. With this structure, the partial washing apparatus keeps its position even if external vibration is transmitted thereto, or if the user's hand touches it, or if the main unit is inclined. This makes it easy to move an article of laundry relative to the partial washing apparatus when it is treated by partial washing.

According to the present invention, a washing machine is provided with a partial washing apparatus that is rotatable in a horizontal plane between a use position where it is placed when in use and a non-use position where it is placed when not in use, locking means for keeping the partial washing apparatus in the non-use or use position is provided, a laundry entrance through which laundry is put in a washing tub is formed in the top face of a main unit, lid state detecting means for detecting the open/closed state of a lid covering the laundry entrance is provided, and the locking means locks the rotation of the partial washing apparatus when the lid state detecting means detects that the lid is open with the partial washing apparatus in the non-use or use position. With this structure, it is possible to prevent collision between the partial washing apparatus and the lid even if the partial washing apparatus has so large a rotation radius as to interfere with the hinged-end portion of the lid in its open state.

In the washing machine structured as described above, the partial washing apparatus is provided with operating means for operating the partial washing apparatus, or operation status indicating means for indicating the operation status of the partial washing apparatus, or both. With this structure, it is possible to operate the partial washing apparatus, or confirm its operation status, instantly without moving the line of sight off the partial washing apparatus.

In the washing machine structured as described above, the partial washing apparatus performs supersonic washing by using a supersonic vibration device. With this structure, it is possible to cope with stubborn stains without damaging laundry.

In the washing machine structured as described above, the supersonic vibration device is composed of a vibration horn coupled to a resonator, a head portion for producing supersonic waves is provided at one end of the vibration horn, and, while vibration is transmitted from the resonator to the head portion, the transmission direction of the vibration is turned substantially perpendicularly. With this structure, even when the supersonic vibration device is housed in the partial washing apparatus that rotates in a horizontal plane, it is possible to make supersonic waves act on the washing portion without loss.

In the washing machine structured as described above, the vibration horn is shaped like a letter T by being composed of a shank portion forming the vertical line of the letter T and the head portion forming the horizontal line of the letter T, the supersonic vibration device is composed of the vibration horn coupled to the resonator, and the head portion achieves washing. With this structure, it is possible to transmit supersonic waves to laundry efficiently and thereby achieve a high washing effect.

In the washing machine structured as described above, part of the head portion is exposed in the washing portion. With this structure, a piece of laundry can be brought into direct contact with the exposed part of the head portion. This permits supersonic energy to be transmitted to the piece of laundry without loss.

DETAILED DESCRIPTION OF THE INVENTION

Figure 1:
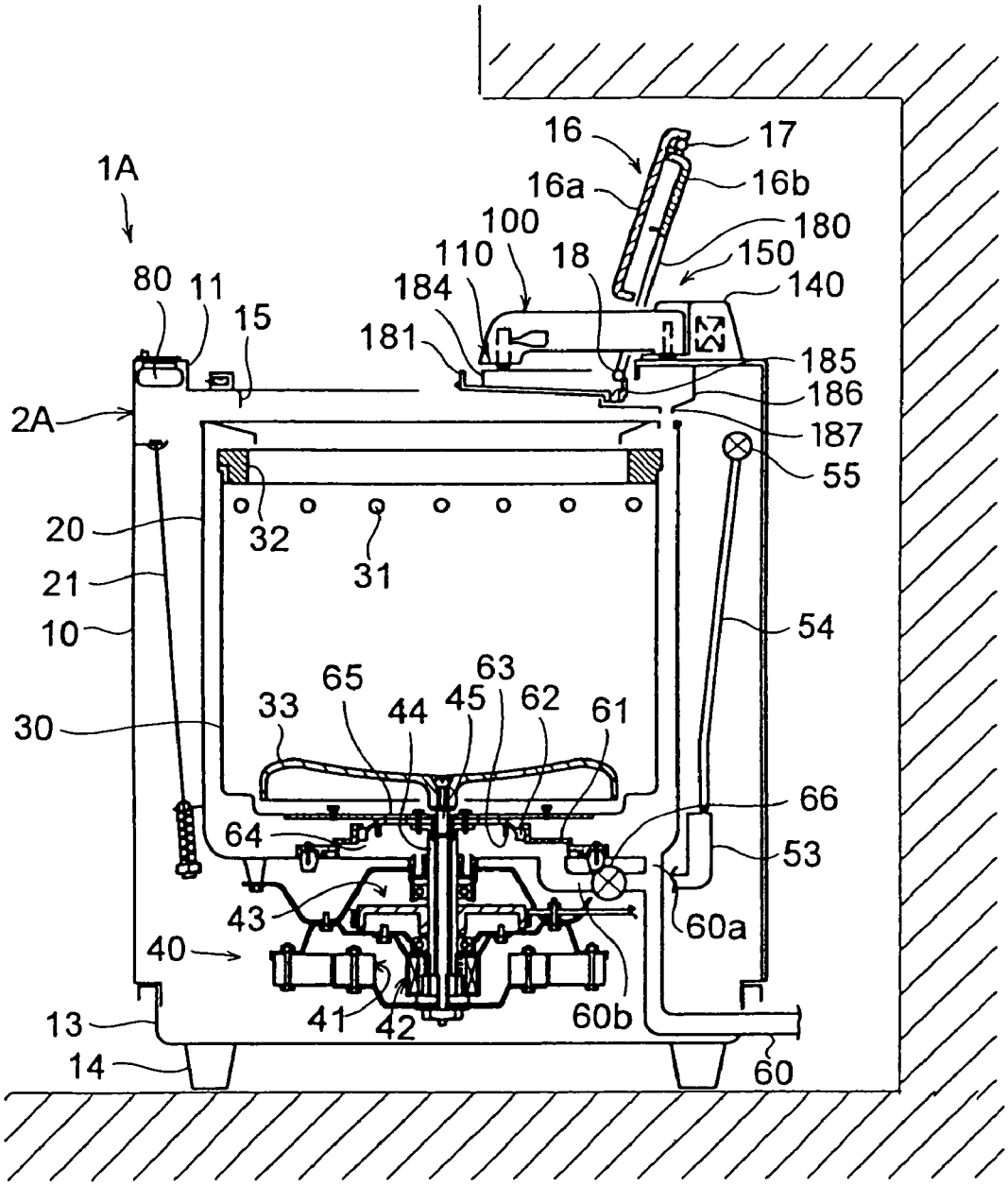
FIG. 1 is a vertical sectional view showing the washing machine of a first embodiment of the invention.

Hereinafter, a first embodiment of the present invention will be described with reference to FIGS. 1 to 19. It is to be noted that the washing machine 1A of the first embodiment is characterized by its partial washing apparatus and the structure around it, and has the same structure in other respects as the conventional washing machine 1 incorporating a partial washing apparatus described earlier in the "Description of Related Art section with reference to FIGS. 21 and 22. Therefore, to avoid overlapping explanations, in the following descriptions, such components that are found also in the conventional washing machine 1 are identified with the same reference numerals, and their explanations will be omitted.

Figure 21:
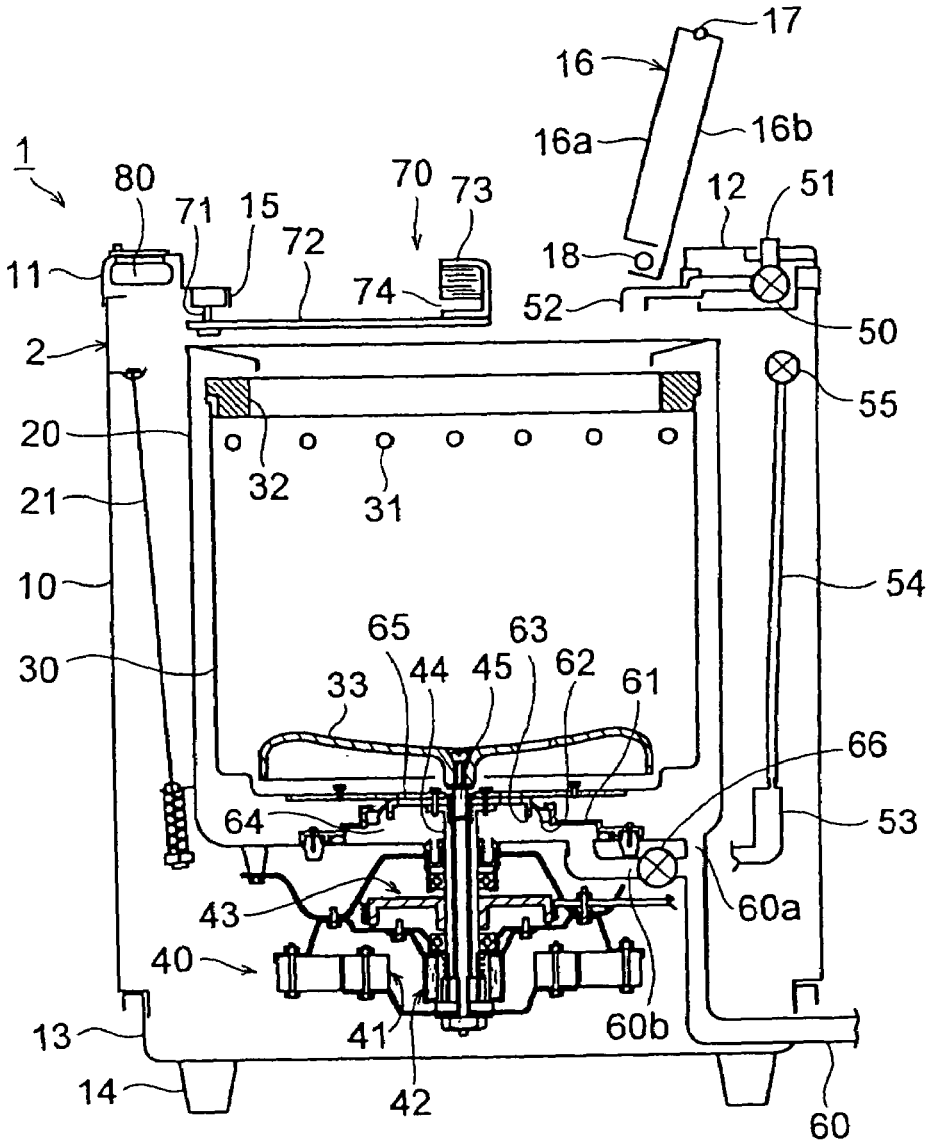
FIG. 21 is a vertical sectional view showing an example of a conventional washing machine.
Figure 22:
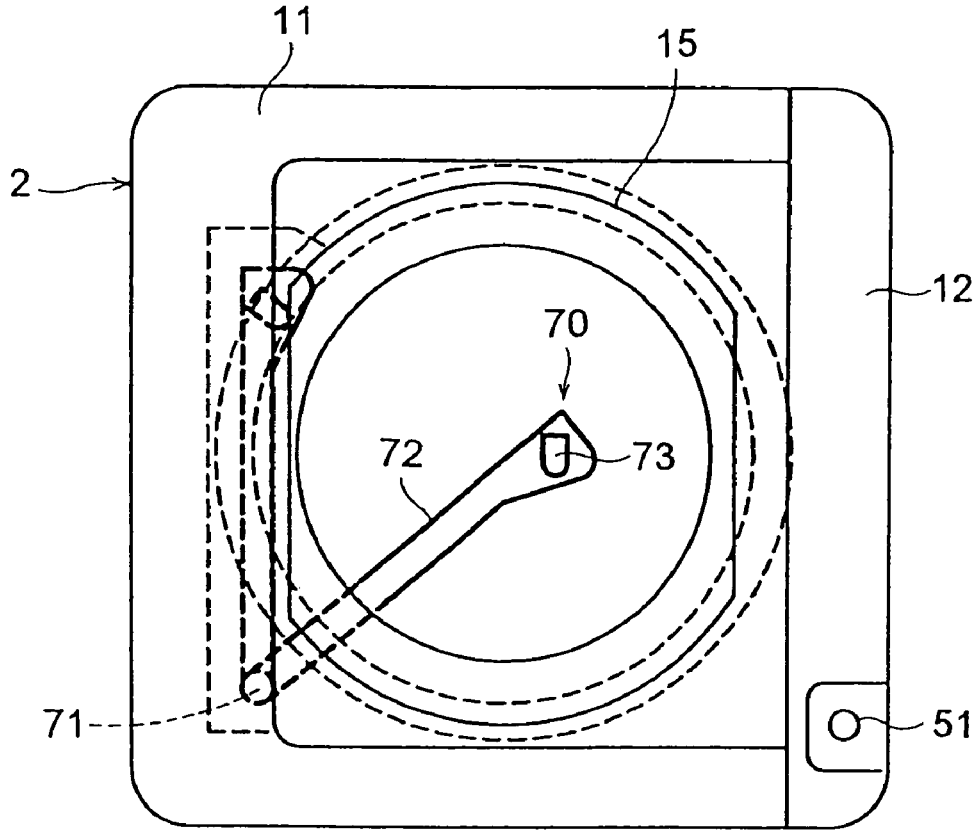

The washing machine 1A of the first embodiment differs from the washing machine 1 shown in FIGS. 21 and 22 in that a partial washing apparatus 100 is fitted on the outer surface of the main unit 2A. The partial washing apparatus 100 has a base 140. The base 140 and the partial washing apparatus 100 are assembled into a unit 150, which is fitted on the top surface of the back panel 12. Now, the structure of the unit 150 will be described with reference mainly to FIGS. 6 to 13.

The base 140, when viewed from the front, has the shape of a segment of a circle, with the top surface of the base 140 describing the arc and the bottom surface the chord. The base 140 is molded out of synthetic resin into a shape having a predetermined thickness in the depth direction. The base 140 has a recess 141 formed in the left half of a front portion thereof to accommodate the partial washing apparatus 100. At the right end of the recess 141, a hollow support shaft 142 is formed to extend vertically upward.

The partial washing apparatus 100 has a hollow case 101. The case 101 is composed of a pair of upper and lower shells 102 and 103 formed out of synthetic resin which are fitted together with unillustrated screws. At one end of the case 101, a vertical bracket 104 is formed. In the case 101, a screwhead recess 105 is formed concentrically with the bracket 104 so that the bottom of the screwhead recess 105 is at a level lower than the top surface of the shell 102. When the case 101 is fitted to the base 140, the bracket 104 is fitted around the support shaft 142 of the base 140 from above, and a screw 106 is screwed through the bottom of the screwhead recess 105 into the support shaft 142. As a result, the case 101 is fitted to the base 140 so as to be rotatble but not movable upward relative thereto. In this way, the partial washing apparatus 100 and the base 140 are assembled into the unit 150. A cap 107 is fitted into the entrance of the screwhead recess 105 to hide the head of the screw 106.

The base 140 is fixed to the back panel 12 with screws 143. It is to be noted that, in FIGS. 6 and 7, only one of the screws 143 is shown. Needless to say, the base 140 is fixed with a plurality of screws 143. In this way, the unit 150 is fixed to the main unit 2A. With the unit 150 fixed to the main unit 2A, the partial washing apparatus 100 is rotatable in a horizontal plane. The partial washing apparatus 100 has its rotation limit in a position where it forms an angle of 90° to the width direction of the base 140. The partial washing apparatus 100 has a washing portion 110 at the bottom of the tip end of the case 101, i.e. the end thereof farther from the rotation center.

When the partial washing apparatus 100 is used, it is placed in an use position, where the washing portion 110 faces the laundry entrance 15 from outside the main unit 2A. When the partial washing apparatus 100 is not used, it is retracted from the position where the washing portion 110 faces the laundry entrance 15 to a non-use position where the entire partial washing apparatus 100 is accommodated in the recess 141 of the base 140. The use position and the non-use position (retracted position) are 90° apart. When the partial washing apparatus 100 is placed in the use or non-use position, it is kept in that position by locking means 160 provided between the partial washing apparatus 100 and the base 140.

The locking means 160 is structured as follows. A lock pin guide 144 is formed inside the base 140. The lock pin guide 144 is formed horizontally and parallel to the width direction of the base 140. In this lock pin guide 144, a lock pin 161 is fitted so as to be slidable in a horizontal direction. The lock pin 161 is pressed against the outer peripheral surface of the bracket 104 by a compression coil spring 162 inserted in the lock pin guide 144. In the outer peripheral surface of the bracket 104, holes 163 and 164 for accommodating the tip of the lock pin 161 are formed 90° apart (see FIG. 8). The lock pin 161 has a knob 165 at the top. The knob 165 is slidably accommodated in a groove 145 formed in the top surface of the base 140 parallel to the lock pin guide 144.

Figure 6:
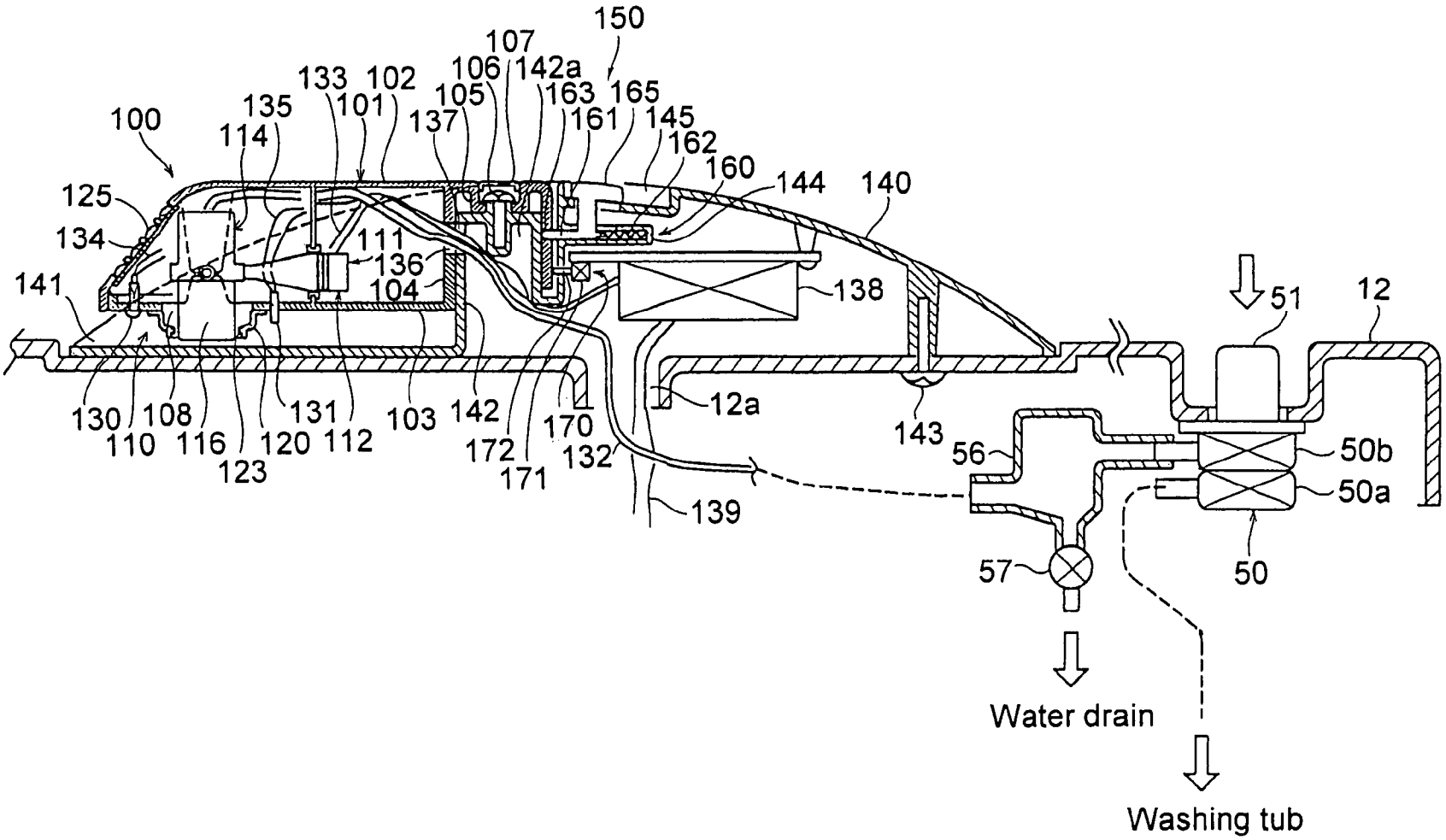
FIG. 6 is a vertical sectional view of the partial washing apparatus and its base.
Figure 7:
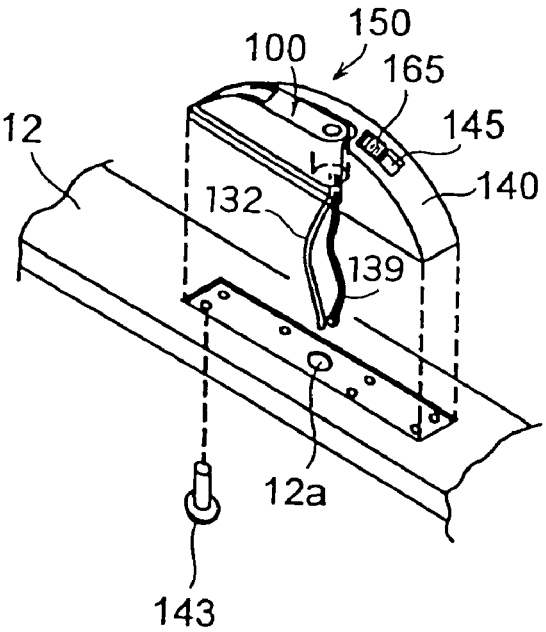
FIG. 7 is a partial perspective view showing how the unit consisting of the partial washing apparatus and its base is fitted to the main unit.
Figure 8:
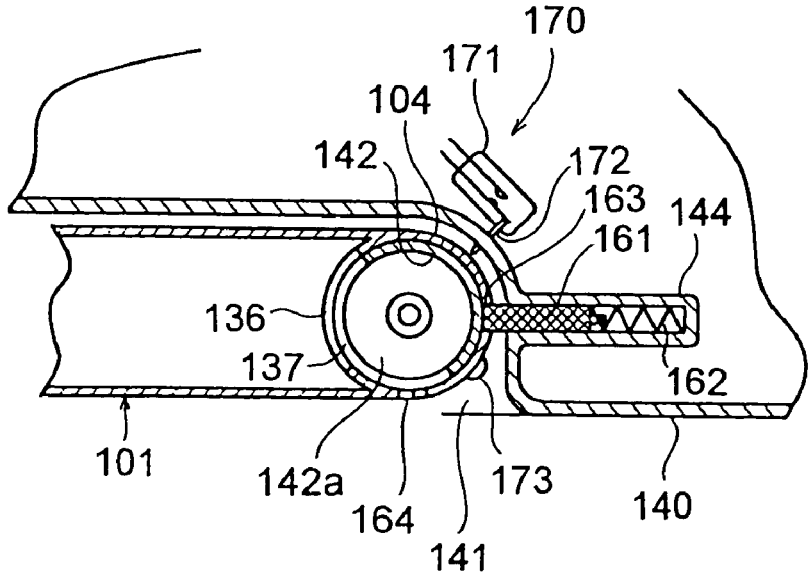
FIG. 8 is a horizontal sectional view of a portion of the partial washing apparatus around the center of rotation thereof.

In FIGS. 6 and 8, the lock pin 161 is shown as being engaged with the hole 163. In this state, the partial washing apparatus 100 is kept in the non-use position. To move the partial washing apparatus 100 to the use position, the knob 165 is pulled rightward in FIG. 6 to disengage the lock pin 161 from the hole 163, and then the partial washing apparatus 100 is rotated counter-clockwise in FIG. 8. After the tip of the lock pin 161 leaves the hole 163, the knob 165 is released so as to let the compression coil spring 162 press the tip of the lock pin 161 against the outer surface of the bracket 104.

When the partial washing apparatus 100 rotates through 90° and reaches the use position, the hole 164 aligns with the lock pin 161, and thus the lock pin 161 engages with the hole 164. As a result, the partial washing apparatus 100 is kept at this angle. To move it back to the non-use position, the knob 165 is pulled, and the partial washing apparatus 100 is rotated clockwise in FIG. 8.

As shown in FIG. 8, position detecting means 170 for detecting the position of the partial washing apparatus 100 is provided inside the base 140. The position detecting means 170 is composed of a switch 171, an actuator 172 that protrudes from the switch 171 and is kept in contact with the outer surface of the bracket 104, and an actuator actuating projection 173 formed on the outer surface of the bracket 104.

In the non-use position shown in FIGS. 6 and 8, the actuator actuating projection 173 is located away from the actuator 172. When the partial washing apparatus 100 rotates through 90° and reaches the use position, the actuator actuating projection 173 hits and presses in the actuator 172, reversing the open/closed state of the switch 171. This produces a signal that indicates that the partial washing apparatus 100 has changed its position. In FIG. 8, the switch 171 is shown as being of a normally open type; however, it may be of a normally closed type.

Figure 11:
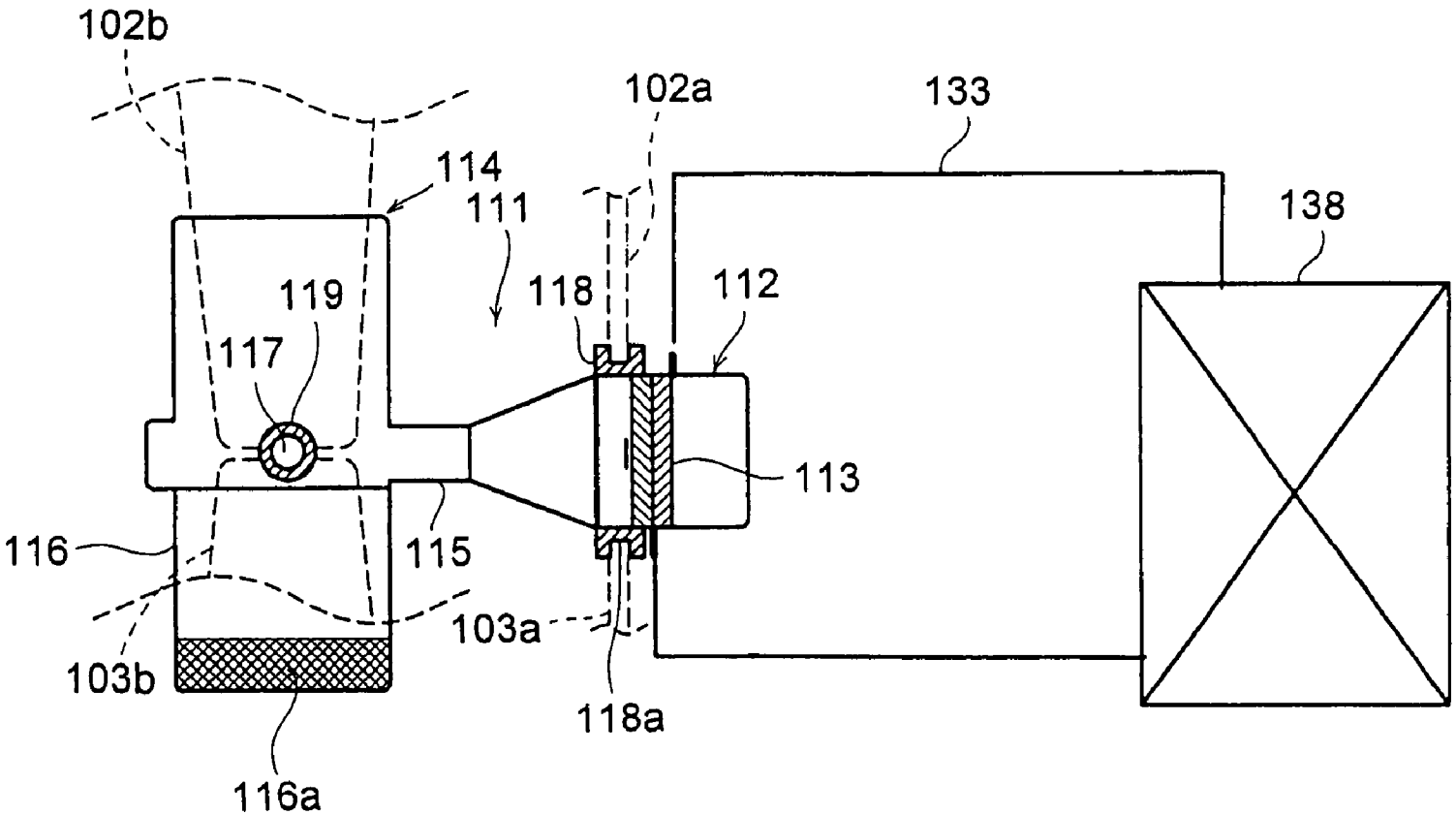
FIG. 11 is a side view of the vibration horn.
Figure 12:
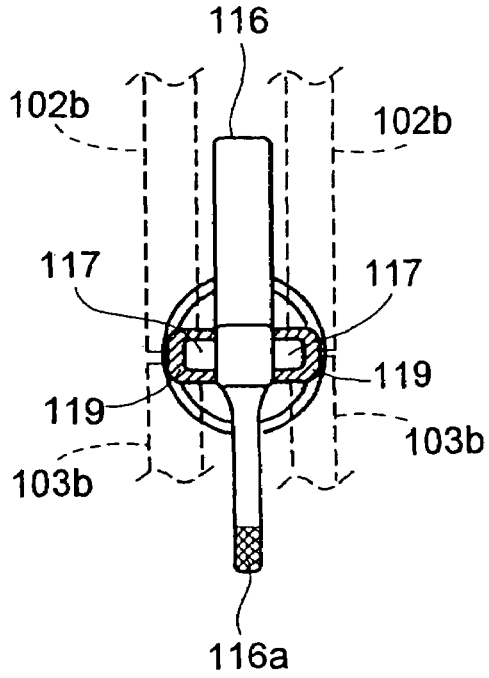
FIG. 12 is a front view of the vibration horn.

Next, the structure of the washing portion 110 will be described. The washing portion 110 is built around a supersonic vibration device 111. As shown in FIG. 11, the supersonic vibration device 111 is composed of a resonator 112 including a resonating element 113, and a T-shaped vibration horn 114 coupled to the resonator 112. The vibration horn 114 is composed of a shank portion 115 fixed to the resonator 112 and a head portion 116 coupled to the tip of the shank portion 115. The shank portion 115 forms the vertical line of the letter T, and the head portion 116 forms the horizontal line of the letter T. The vibration generated by the resonator 112 is transmitted from the shank portion 115 to the head portion 116, with the transmission direction of the vibration turned substantially perpendicularly on the way. As a result, the head portion 116 emits supersonic waves.

From both side surfaces of the head portion 116, projections 117 protrude symmetrically. The projections 117 are located in a non-vibrating region, i.e. at the branch point of vibration transmission.

The supersonic vibration device 111 is housed inside the case 101 of the partial washing apparatus 100, with the T-shaped vibration horn 114 turned sideways. The supersonic vibration device 111 is supported in the following manner. A ring-shaped damping member 118 is fitted around the resonator 112. The damping member 118 is formed out of soft rubber or synthetic resin, and has a ring-shaped groove 118*a* formed around the outer periphery thereof. Cap-shaped damping members 119 are fitted around the projections 117.

These damping members 118 and 119 are held between ribs that are formed on the inner surfaces of the shells 102 and 103 integrally therewith. Specifically, on the part of the resonator 112, the damping member 118 is held between a rib 102*a* formed on the shell 102 and a rib 103*a* formed on the rib 103, with the tips of these ribs engaged with the groove 118*a*. In this way, the resonator 112 is supported. Moreover, on the part of the vibration horn 114, the damping members 119 are held between ribs 102*b* formed on the shell 102 and ribs 103*b* formed on the shell 103. In this way, the vibration horn 114 is supported.

An opening 108 is formed in the shell 103 to permit a lower portion of the head portion 116 of the vibration horn 114 to stick out of the case 101. The tip of this sticking-out portion makes contact with a piece of laundry. The portion that makes contact with the laundry is a chromium-plated portion 116*a*. The chromium plating here serves to make the settlement of dirt thereon difficult and to keep the surface smooth so that the laundry is not caught thereon.

Figure 10:
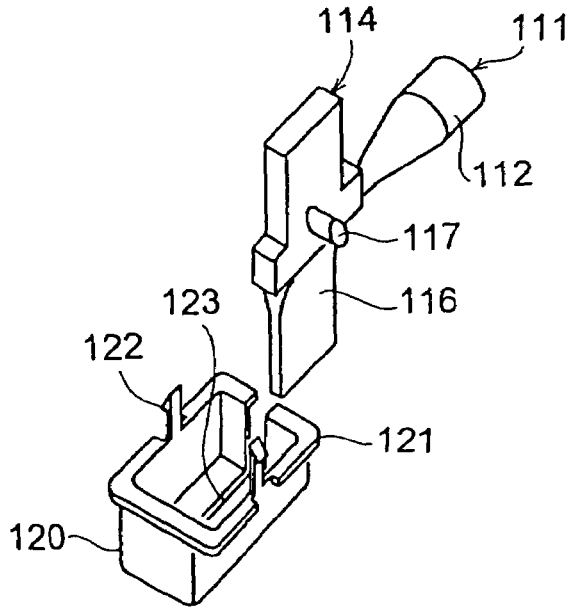
FIG. 10 is a perspective view of the vibration horn and the horn cover constituting the partial washing apparatus.

The opening 108 is fitted with a horn cover 120 made of synthetic resin. As shown in FIG. 10, the horn cover 120 has the shape of a rectangular parallelepiped open at the top. At the rim of the top opening of the horn cover 120, a flange 121 is formed so as to extend horizontally, and a pair of elastic claws 122 is formed so as to protrude upward.

In the bottom surface of the horn cover 120, a slit 123 is formed to permit the lower portion of the head portion 116 of the vibration horn 114 to be exposed. The lower portion of the head portion 116 of the vibration horn 114 is put through the slit 123 so as to stick 1 to 5 mm out of the horn cover 120. The gap between the bottom surface of the head portion 116 of the vibration horn 114 and the top surface of the tray described later is set to be 5 to 13 mm to permit easy insertion of a piece of laundry but prevents entry of the user's finger.

On both sides of the slit 123, cleaning fluid dripping holes 124 are formed. When the elastic claws 122 are put into the opening 108 and are engaged with the upper rim of the opening 108, the shell 103 is held between the elastic claws 122 and the flange 121. In this way, the horn cover 120 is fitted to the shell 103.

Figure 13:
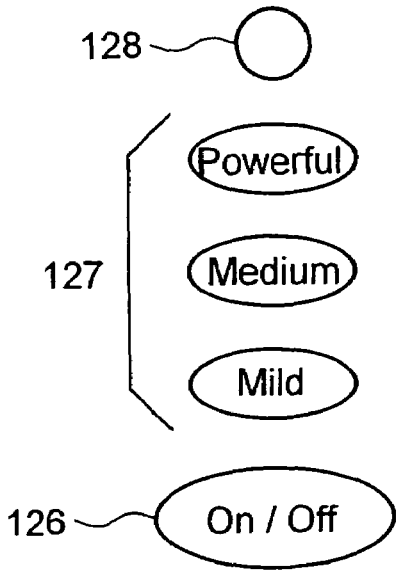
FIG. 13 is a diagram showing the arrangement of elements on the operation panel of the partial washing apparatus.

Inside the partial washing apparatus 100 are arranged, in addition to the supersonic vibration device 111, the following components. On the front face of the case 101, a operation panel 125 is arranged. On the operation panel 125, operating means and operation status indicating means are arranged. The operating means is composed of operation buttons, and the operation status indicating means is composed of a lamp. As shown in FIG. 13, the operating means and the operation status indicating means are arranged vertically. At the bottom is located an on/off button 126, above which is located a group of three intensity setting buttons 127 consisting of a "powerful", a "medium", and a "mild" button. Further above is located the operation status indicating means 128 consisting of an LED lamp. The on/off button 126 is of an "on/off" type, and permits the operation of the partial washing apparatus 100 to be started and stopped with the push of the button. Here, the partial washing apparatus 100 starts operating not when the start/stop button 126 is pressed only momentarily but when it is held pressed for a predetermined period (for example, 1 to 2 seconds).

The operating means may be realized with a selector switch of a dial or slide type. The operation status indicating means may be realized with a flat display panel such as a liquid crystal display. The operation status may be indicated with sound alone or in combination.

On the bottom surface of the case 101 are arranged spot illuminating means 130 and tray detecting means 131. With respect to the rotation center of the partial washing apparatus 100, the spot illuminating means 130 is located outside the horn cover 120, and the tray detecting means 131 is located inside the horn cover 120. The spot illuminating means 130 is composed of an LED lamp or the like. The tray detecting means 131 senses whether the tray described later is present below the partial washing apparatus 100, and is composed of a reflective optical sensor.

Figure 9:
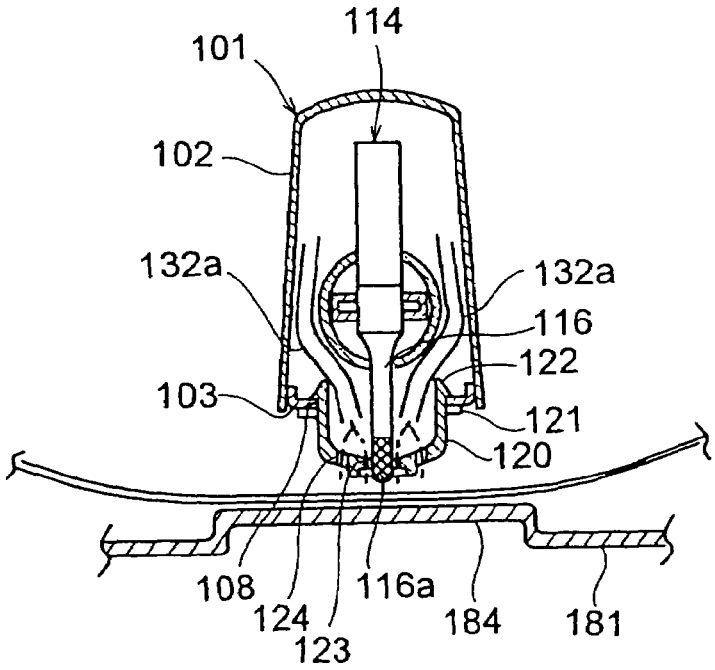
FIG. 9 is a vertical sectional view of the washing portion of the partial washing apparatus.

Inside the case 101, a cleaning fluid tube 132 is laid. The tip of the cleaning fluid tube 132 is bifurcated to form water feed portions 132*a*. As shown in FIG. 9, these water feed portions 132*a* are arranged on both sides of the vibration horn 114, so that cleaning fluid is discharged on both sides of the head portion 116.

Electric leads 133 to the supersonic vibration device 111, electric leads 143 to the spot illuminating means 130, electric leads 135 to the tray detecting means 131, and the cleaning fluid tube 132 run through slits 136 and 137 formed in the bracket 104 and the support shaft 142 into the support shaft 142. That is, the inside of the support shaft 142 serves as a duct 142*a* through which are laid electric leads for data exchange and power supply and a pipe for water (fluid) supply. As the partial washing apparatus 100 rotates, the leads 133, 134, and 135, and the cleaning fluid tube 132 move. Therefore, the slits 136 and 137 need to be formed so as to be sufficiently wide to permit the movement of those leads and pipe.

Inside the base 140, a control circuit 138 for the partial washing apparatus is arranged. Connected to this control circuit 138 are the electric leads 133, 134, 135 that run out of the duct 142*a* and also electric leads (not shown) that are connected to the position detecting means 170. The control circuit 138 includes a supersonic oscillation circuit for the supersonic vibration device 111. From the control circuit 138 run electric leads 139 that connect to the controller 80. The electric leads 139 and the cleaning fluid tube 132 run through a hole 12*a* formed in the back panel 12 to under the back panel 12, and then lead to where they are connected.

The water feed valve 50 has valves 50*a* and 50*b* that open and close independently. One valve 50*a* connects to the water feed nozzle 52 shown in FIG. 21; the other value 50*b* connects to a water feed joint 56, to which the cleaning fluid tube 132 connects. The water feed joint 56 is provided with a drain valve 57 as draining means. When the drain valve 57 is opened, water left in the water feed joint 56 and the cleaning fluid tube 132 is drained into the space between the water tub 20 and the washing tub 30.

Fitting the partial washing apparatus 100 on the outer surface of the main unit 2A has necessitated modifications in the structure of the lid 16. In the rear lid 16*b*, a large cut is formed from the side thereof hinged on the shaft 18 to form a gate opening 180 through which to let the partial washing apparatus 100 pass. Thus, the rear lid 16*b* itself is shaped like a portal. The gate opening 180 has so large a depth dimension (with the rear lid 16*b* raised upright, a height dimension) that, with the partial washing apparatus 100 placed in the use position, the rear lid 16*b* can be opened and closed without interference with the partial washing apparatus 100.

Figure 2:
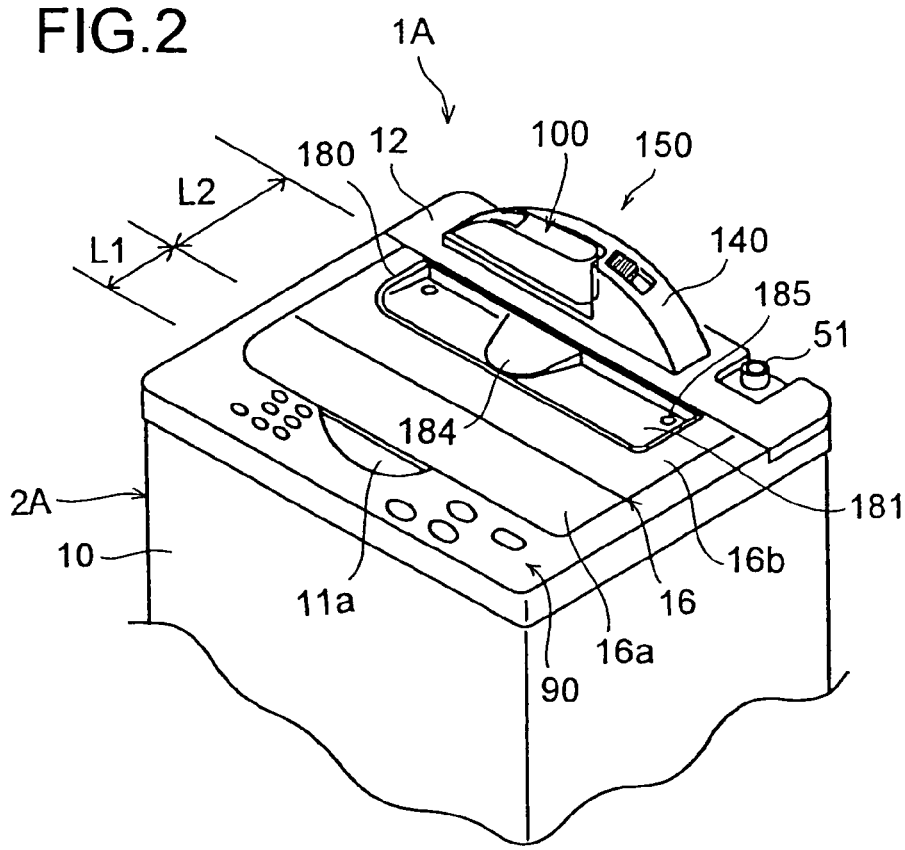
FIG. 2 is a partial perspective view of the washing machine of the first embodiment.
Figure 3:
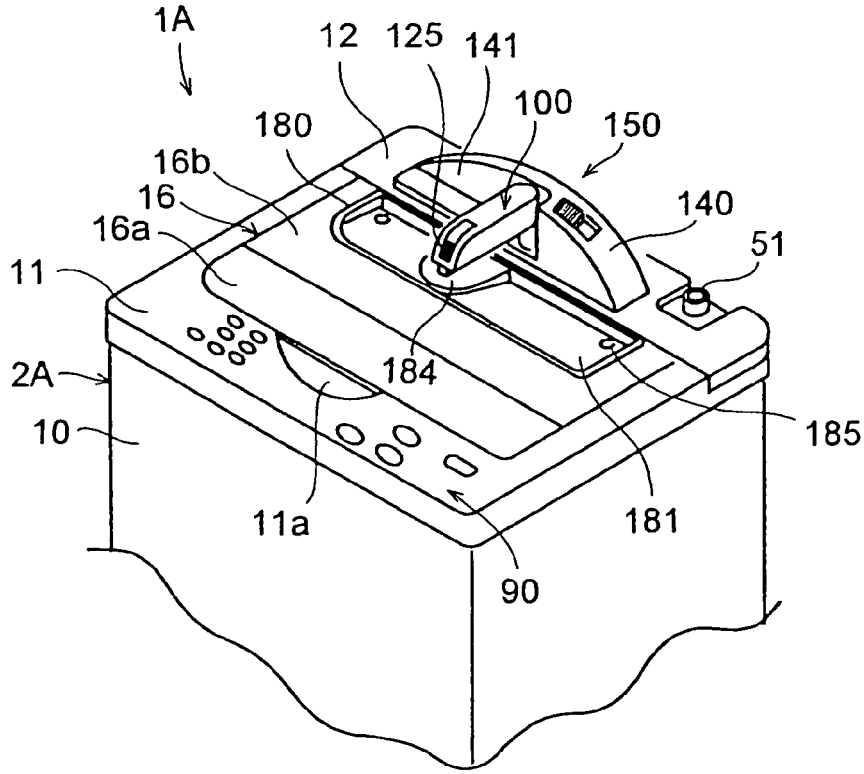
FIG. 3 is a partial perspective view similar to FIG. 2, with the partial washing apparatus placed in a different position from in FIG. 2.

The dimensional relationship between the front lid 16*a* and the rear lid 16*b* is so set that, when the rear lid 16*b* is raised upright and the front lid 16*a* is flipped over along the shaft 17 so that the entire lid 16 is folded in two, the front lid 16*a* does not collide with the partial washing apparatus 100. In FIG. 2, the depth dimension $L_1$ of the front lid 16*a* is smaller than the depth dimension $L_2$ of the rear lid 16*b*. The dimensional ratio of $L_1$ to $L_2$ is so set that $L_1$ is equal to 50 to 80% of $L_2$. In this way, the front lid 16*a* is prevented from colliding with the partial washing apparatus 100 even with the partial washing apparatus 100 placed in the non-use position.

In the gate opening 180, a tray 181 for sustaining a piece of laundry is arranged. The tray 181 closes the gate opening 180. The tray 181 may close the gate opening 180 completely (as in the first embodiment), or partially with a gap left.

Figure 14:
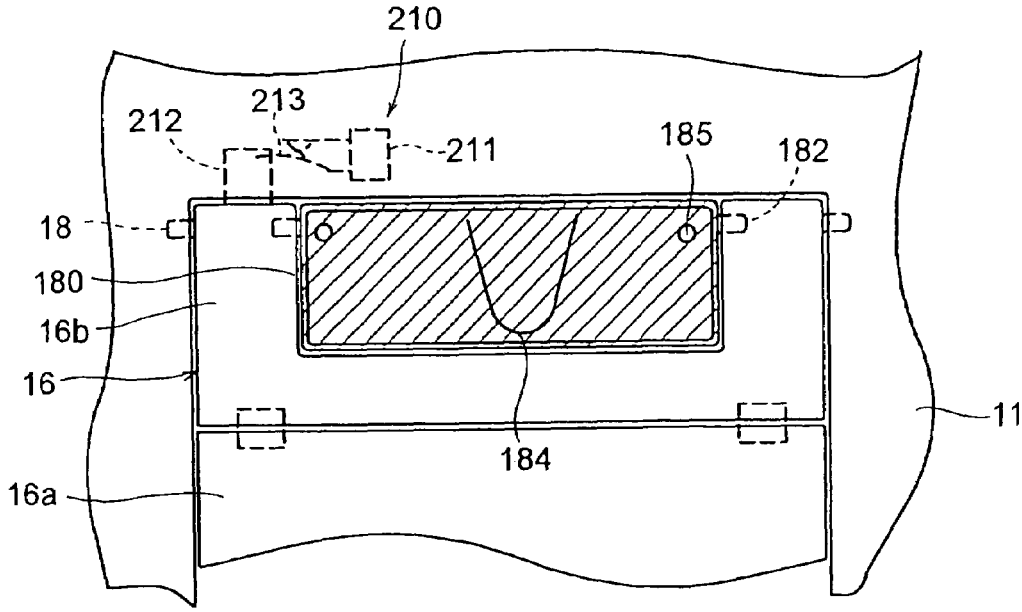
FIG. 14 is a top view showing the arrangement of the lid and the tray combined therewith and their fitting structure.
Figure 15:
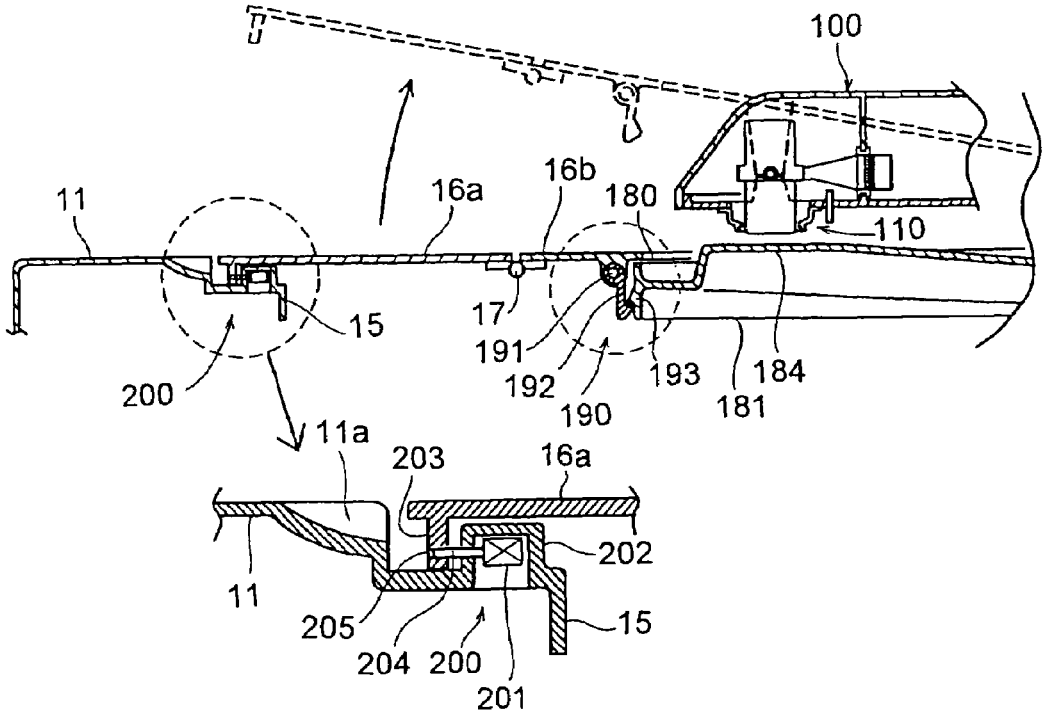
FIG. 15 is a vertical sectional view showing the coupling means between the lid and the tray and the locking means for the lid.

As shown in FIG. 15, the tray 181 is fitted in the rear lid 16*b* from below. As shown in FIG. 14, the tray 181 is hinged to the rear lid 16*b* with shafts 182 protruding from both sides of the tray 181. The axis of the shafts 182 coincides with the axis of the shaft 18 on which the rear lid 16*b* is hinged to the top plate 11. Thus, like the rear lid 16*b*, the tray 181 is rotatable in a vertical plane.

Figure 4:
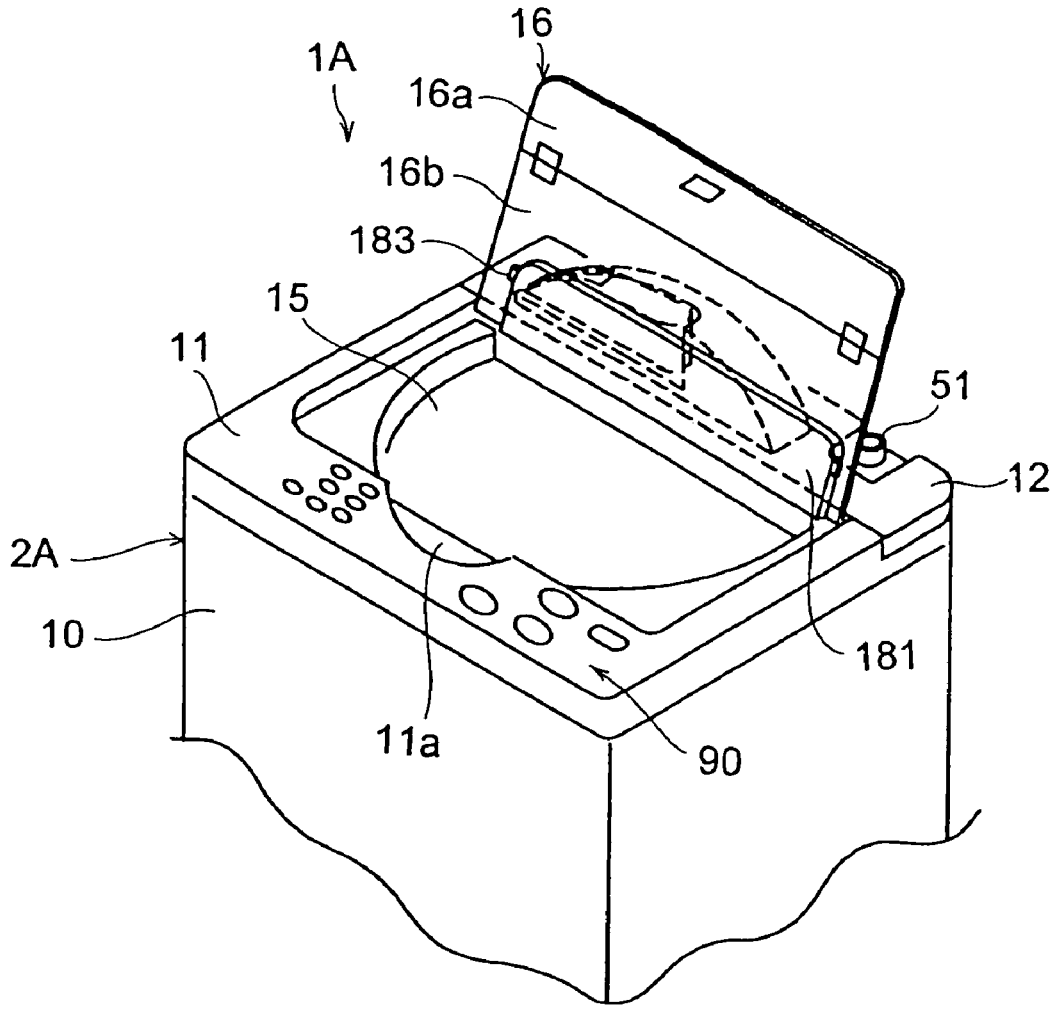
FIG. 4 is a partial perspective view similar to FIG. 2, with the lid of the washing machine open.
Figure 5:
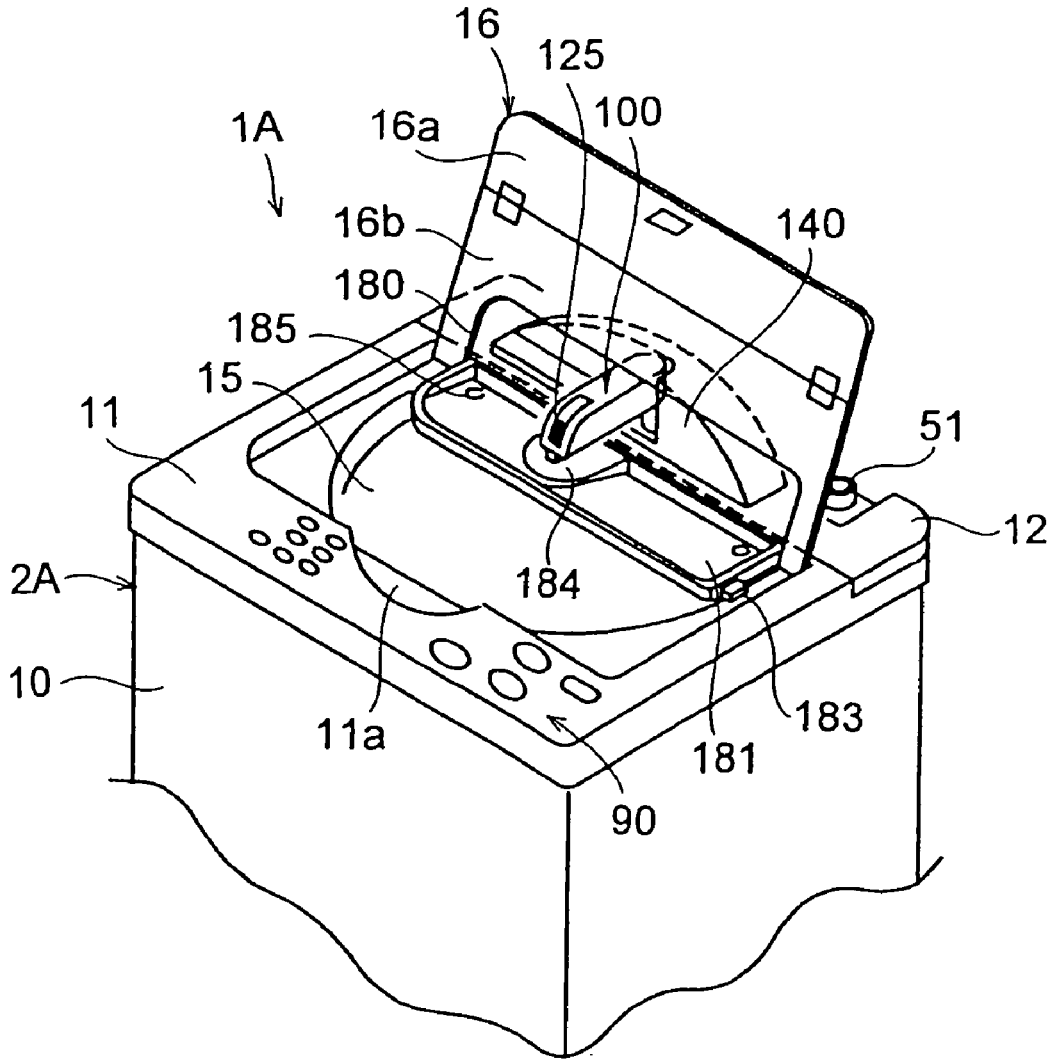
FIG. 5 is a partial perspective view similar to FIG. 3, with the lid of the washing machine open.

As shown in FIGS. 4 and 5, projections 183 are formed on both sides of the tray 181. These projections 183 engage with the rim of the laundry entrance 15. This prevents the tray 181 from dropping below the laundry entrance 15.

The top surface of the tray 181 is formed into a basin-like shape, with a central portion thereof elevated to form a stage 184. The stage 184 faces the washing portion 110 of the partial washing apparatus 100 when it is placed in the use position. On both sides of the stage 184, the bottom surface of the tray 181 is inclined so as to be increasingly low rearward. In the lowest portions of the bottom surface on both sides of the stage 184, drain outlets 185 are formed, one on each side. The fluid that drips from the article of laundry being treated by partial washing is drained through the drain outlets 185 into a drain path.

The drain outlets 185 are open toward or communicate with a drain path that leads to outside the washing machine. In the first embodiment, the drain path is structured as follows. Inside the main unit 2A, a gutter 186 for collecting water drained through the drain outlets 185 is arranged (see FIG. 1). The gutter 186 has a drain outlet 187 of its own, through which the water collected therein is allowed to drop into the space between the water tub 20 and the washing tub 30. The water that has dropped into the space between the water tub 20 and the washing tub 30 is discharged through the drain hose 60 to outside the washing machine. In this way, the gutter 186, the space between the water tub 20 and the washing tub 30, and the drain hose 60 together form the drain path.

Here, the drain outlets 185 of the tray 181 are open toward the gutter 186, and the drain outlet 187 of the gutter 186 is open toward the space between the water tub 20 and the washing tub 30. Thus, an open drain path is formed. However, a more hermetic drain path is possible. For example, a drain hose dedicated to the tray 181 is laid outside the water tub 20 so as to communicate with the drain outlets 185. This drain hose may be connected to the drain hose 60, or may be led out of the main unit 2A separately from the drain hose 60.

Between the rear lid 16*b* and the tray 181, removable coupling means 190 is provided. Its mechanism will be described below with reference to FIG. 15. A hook 192 is hinged, with a shaft 191, to the bottom surface of the rear lid 16*b* (the surface that faces frontward when the rear lid 16*b* is raised upright). The hook 192 is rotatable in a vertical plane, and is pressed into the position shown in FIG. 15 by an unillustrated torsion coil spring. On the other hand, a projection 193 that engages with the hook 192 is formed at the free end of the tray 181. The engagement surface of the hook 192 facing the projection 193 and the engagement surface of the projection 193 facing the hook 192 are both inclined so that a moderate force is required to disengage the hook 192 and the projection 193 from each other, that is, they are disengaged on application of a moderate force.

On the top plate 11, locking means 200 for locking the lid 16 in a closed state is provided. The structure of the locking means 200 is shown in a partial enlarged view shown as part of FIG. 15. The locking means 200 is composed of a solenoid 201. The solenoid 201 is arranged in a pocket 202 formed on the top plate 11 in a position corresponding to the front edge of the laundry entrance 15. The pocket 202 protrudes upward and is open downward.

On the front lid 16*a*, a projection 203 is formed so as to overlap the front face of the pocket 202. The solenoid 201 is arranged in the pocket 202, with a plunger 204 of the former protruding from the front face of the latter. The plunger 204 engages with a hole 205 formed in the projection 203.

When, with the lid 16 closed, the controller 80 energizes the solenoid 201, the plunger 204 thrusts forward and engages with the hole 205. In this state, the lid 16 cannot be opened. When the solenoid 201 is de-energized, the plunger 204 retracts and disengages from the hole 205. In this state, the lid 16 can be opened. In the top plate 11, a depression 11*a* is formed to make it easy for the user to put his or her finger on the front edge of the front lid 16*a*.

On the top plate 11, lid state detecting means 210 for detecting the open/closed state of the lid 16 is provided. FIG. 14 shows the structure of the lid state detecting means 210. The lid state detecting means 210 is composed of a switch 211 arranged near the rotation center of the rear lid 16*b* and an arm 212 protruding from the rear lid 16*b*. When the lid 16 is closed, the arm 212 hits and moves an actuator 213 of the switch 211. This causes the switch 211 to produce a signal, which is transmitted to the controller 80. When the lid 16 is opened, the arm 212 moves off the actuator 213. This causes the switch 211 to change states and transmit a different signal to the controller 80.

The switch 211 and the arm 212 are arranged beneath the top plate 11. The relationship between the arm 212 and the actuator 213 may be reversed so that, when the lid 16 is opened, the arm 212 hits the actuator 213 and, when the lid 16 is closed, the arm 212 moves off the actuator 213.

The top surface of a front portion of the top plate 11 is formed into an operation panel 90 (see FIGS. 2 to 5). On the operation panel 90 are arranged various operation buttons, such as start/stop and washing course selection buttons, for controlling the operation of the main unit 2A, and also operation status indicating means for indicating the operation status of the main unit 2A. The operation status indicating means is composed of a liquid crystal display panel or LED lamps.

Next, the operation of the washing machine 1A of the first embodiment will be described. Here, washing operation using the washing tub 30 provided inside the main unit 2A is performed in the same manner as in the conventional washing machine 1, and therefore no explanation will be given on washing operation. Washing is performed with the partial washing apparatus 100 placed in the non-use position.

When dirt persists on parts of laundry after washing, or when stains are found before washing which are unlikely to be removed by ordinary washing, the partial washing apparatus 100 is used. The partial washing apparatus 100 cannot be used when it is in the non-use position. This is because a signal indicating that the partial washing apparatus 100 is in the non-use position is transmitted from the position detecting means 170 to the control circuit 138 or to the controller 80 controlling the control circuit 138 so that the partial washing apparatus 100 is inhibited from being operated. Thus, first of all, it is necessary to unlock the locking means 160 and rotate the partial washing apparatus 100 through 90° in a horizontal plane to move it to the use position.

The partial washing apparatus 100 is rotated with the lid 16 closed. This is because, if the lid 16 is open, the tip of the partial washing apparatus 100 collides with the hinged-end portion of the lid 16 (i.e. the hinged-end portion of the rear lid 16*b*) when the partial washing apparatus 100 is rotated from the non-use position. When the partial washing apparatus 100 rotates above the closed lid 16 and reaches the angle at which it is used, the locking means 160 is locked again to keep the partial washing apparatus 100 in that position. The position detecting means 170 detects that the partial washing apparatus 100 has reached the use position, and transmits a signal to the control circuit 138 and the controller 80. The position detecting means 170 may start operating when the power switch of the washing machine 1A is turned on.

On receiving the signal indicating that the partial washing apparatus 100 has reached the use position, the control circuit 138 activates the tray detecting means 131. The tray detecting means 131 senses whether the tray 181 is present below the partial washing apparatus 100 and is in a usable condition, i.e. without breakage or dropping off. If the tray 181 is found to be present there in a usable condition, the control circuit 138 makes the supersonic oscillation circuit ready for operation, and lights the operation status indicating means 128 and the spot illuminating means 130. The tray detecting means 131 may start operating when the on/off button 126 of the partial washing apparatus 100 is pressed.

If the tray detecting means 131 cannot detect the presence of the tray 181 because it is broken or has dropped off, the operation status indicating means 128 is blinked or is lit with a different color to inform the user of the fault. Now, no operation of the on/off button 126 or the intensity setting buttons 127 is accepted, and the partial washing apparatus 100 is inhibited from being operated.

The detection of the presence of the tray 181 is started after the position detecting means 170 detects that the partial washing apparatus 100 has reached the use position, that is, after the actuator actuating projection 173 hits the actuator 172. Alternatively, where the detection of the presence of the tray 181 is started when the on/off button 126 is pressed, it is started when the on/off button 126 is pressed. The detection is performed in a predetermined short period (for example, 0.5 to 1 second) after the start thereof The period is limited here because, if the tray 181 is broken or has dropped off, there is a risk of the user's finger touching the vibration horn 114 and therefore it is necessary to decide not to vibrate the vibration horn 114 as early as possible.

When the operation status indicating means 128 is lit normally, the lid 16 is opened. As the lid 16 is raised, the tray 181 is raised together by coupling means 190. As the tray 181 is raised, it collides with the partial washing apparatus 100.

The partial washing apparatus 100 may be designed to move in any manner than rotate in a vertical plane; specifically, here, it is designed to rotate in a horizontal plane. This means that the tray 181 cannot lift the partial washing apparatus 100 up. Thus, when the tray 181 collides with the partial washing apparatus 100, the tray 181 is no longer allowed to follow the lid 16, and the coupling means 190 decouples, permitting the lid 16 to rotate further but leaving the tray 181 below the partial washing apparatus 100. The tray 181 thus left behind engages with the rim of the laundry entrance 15, and is thereby held there with a gap secured between the stage 184 and the washing portion 110 of the partial washing apparatus 100. This gap is set to be 5 to 13 mm as described earlier so as to permit insertion of a piece of laundry but prevents entry of the user's finger. Thus, there is little risk of the user's finger touching the vibration horn 114 vibrating at a supersonic frequency.

When the lid 16 is completely open, it is folded in two. As described earlier, doing so does not make the front lid 16*a* make contact with the partial washing apparatus 100. In a situation where an obstacle is located near above the main unit 2A as shown in FIG. 1, the lid 16 is opened while it is gradually folded in two.

The locking means 200 is for keeping the lid 16 in a closed state to prevent the user's finger or the like from touching the washing tub 30, the pulsator 33, or the laundry in a washing or dewatering process. The locking means 200 can be used in the following manner as well. When the partial washing apparatus 100 is in the non-use or use position, the lid 16 can be opened and closed without interference with the partial washing apparatus 100. However, when the partial washing apparatus 100 is in any other position at any other angle, the lid 16 may interfere with the partial washing apparatus 100 depending on the angle. This can be avoided by enabling the position detecting means 170 to detect the partial washing apparatus 100 both in the non-use and use positions. This can be achieved easily by adding another actuator actuating projection 173. When the partial washing apparatus 100 is located midway between the non-use and use positions, and the position detecting means 170 produces no signal, it is judged that opening the lid 16 may cause interference, and therefore the lid 16 is locked by the locking means 200. When the partial washing apparatus 100 is moved to the non-use or use position, and the position detecting means 170 produces a signal, the locking by the locking means 200 is unlocked.

The reason that the lid 16 is opened when the partial washing apparatus 100 is placed in the use position is that, if the lid 16 is left closed, the cleaning fluid fed to the partial washing apparatus 100 may make the top surface of the lid 16, and hence the floor surface, wet.

After making preparations for using the partial washing apparatus 100 in this way, a piece of laundry is put on the tray 181, and the on/off button 126 on the operation panel 125 is pressed. As described earlier, simply pressing the on/off button 126 momentarily does not make the partial washing apparatus 100 start operating; holding it pressed for a predetermined period does. This helps avoid unexpected starting of operation as when the user has inadvertently touched the on/off button 126 or a child has pressed it out of mischief. After the presence of the tray 181 is detected, and the operation of the partial washing apparatus 100 is started with the press of the on/off button 126, the tray detecting means 131 restarts detection. The purpose of restarting detection here is to check whether the tray 181 is not broken under the weight of the article of laundry or the pressure of the user's hands. The power to the tray detecting means 131 may be automatically shut off, or the oscillation may be automatically stopped, if no fault is detected for a predetermined period (for example 1 to 10 minutes).

When the operation of the partial washing apparatus 100 is started, the valve 50*b* of the water feed valve 50 is opened, and water is supplied to the cleaning fluid tube 132 at a predetermined rate, for example 50 to 300 cc/min. The water is poured from the water feed portions 132*a* to both sides of the vibration horn 114, and the water then drips through the slit 123 and the cleaning fluid dripping holes 124 onto the tray 181. Subsequently, the supersonic vibration device 111 starts vibrating at a supersonic frequency. In this state, the article of laundry is passed slowly through the gap between the head portion 116 of the vibration horn 114 and the stage 184. Supersonic waves concentrate on the laundry and removes dirt components therefrom. The dirt components thus removed, together with the water, flow out through the drain outlets 185, are collected in the gutter 186, drop through the drain outlet 187 of the gutter 186 into the space between the water tub 20 and the washing tub 30, and are discharged through the drain hose 60 out of the main unit 2A.

While the partial washing apparatus 100 continues operating, the operation status indicating means 128 is kept lit to warn the user that supersonic waves are being generated. The intensity of supersonic washing can be switched by operating the intensity setting buttons 127. Moreover, the spot illuminating means 130 is lit so that the user can closely check whether dirt has been removed or not. The spot illuminating means 130 is lit automatically when the partial washing apparatus 100 is operating. An on/off switch may be provided separately to permit the spot illuminating means 130 to be lit manually only when desired.

In the structure described above, simply water is poured from the water feed portions 132*a*. It is also possible to add an additive such as detergent to the water to obtain a greater washing effect. This can be achieved by providing an additive mixer on the way along the cleaning fluid tube 132, or by connecting the cleaning fluid tube 132 to a cleaning fluid tank provided separately.

When partial washing is finished in this way, the laundry is put in the washing tub 30, and washing is started anew, or, where washing is omitted, rinsing and dewatering are performed. For safety, the partial washing apparatus 100 may be automatically turned off a predetermined period (for example, 3 to 10 minutes) after the start of operation.

To perform washing or rinsing, the lid 16 needs to be closed. Here, the lid 16 is closed with the partial washing apparatus 100 left in the use position. When the partial washing apparatus 100 is located midway between the use and non-use positions, there is a risk of the partial washing apparatus 100 interfering with the lid 16, and therefore the lid 16 should not be opened or closed.

The operation of the main unit 2A may be controlled in a manner correlated to the position of the partial washing apparatus 100 so as to inhibit washing and rinsing in the washing tub 30 unless the position detecting means 170 is detecting that the partial washing apparatus 100 is in the non-use position. This eliminates the risk that the article of laundry being treated by partial washing is pulled into the stream of water in the washing tub 30 and the user's hand is pulled into it together.

When the lid 16 is closed, the coupling means 190 couples. If the partial washing apparatus 100 has returned to the non-use position, thereafter the tray 181 is opened and closed together with the lid 16.

In the partial washing machine of the first embodiment described above, various parts thereof may be modified as described below.

Figure 16:
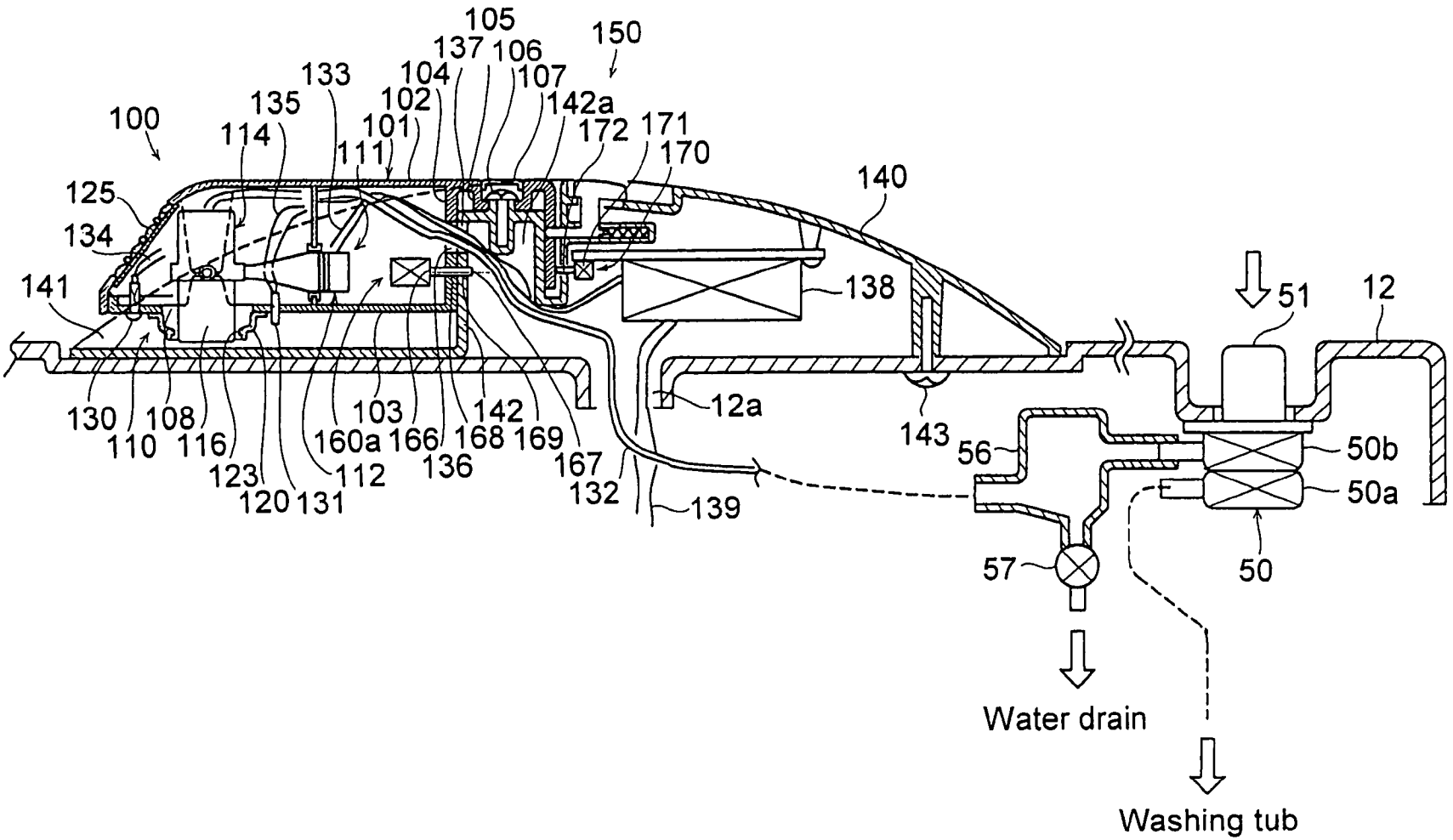
FIG. 16 is a vertical sectional view similar to FIG. 6, showing the partial washing apparatus locking means with a different structure.

The locking means of the partial washing apparatus 100 may be structured as shown in FIG. 16. The locking means 160*a* shown in FIG. 16 has no manually operated parts, and achieves the locking of the partial washing apparatus 100 with a plunger 167 of a solenoid 166. The plunger 167 engages, through a hole 168 formed in the bracket 104, with one of two holes 169 formed in the support shaft 142. Like the holes 163 and 164 shown in FIG. 8, the two holes 169 are arranged 90° apart. As a result of the plunger 167 engaging with one of the holes 169, the partial washing apparatus 100 is kept in the non-use or use position. When the solenoid 166 changes energization states and the plunger 167 comes out of the hole 169, the partial washing apparatus 100 is ready to be rotated.

In a case where electromagnetic locking means 160*a* like this is adopted, the locking means 160*a* may be controlled according to the information from the position detecting means 170.

The manual locking means 160 or the solenoid-type locking means 160*a* may be used singly, or both may be used in combination. In the above descriptions, the manual locking means 160 is provided inside the base 140, and the solenoid-type locking means 160*a* is provided inside the partial washing apparatus 100. However, these may be arranged the other way around.

Figure 17:
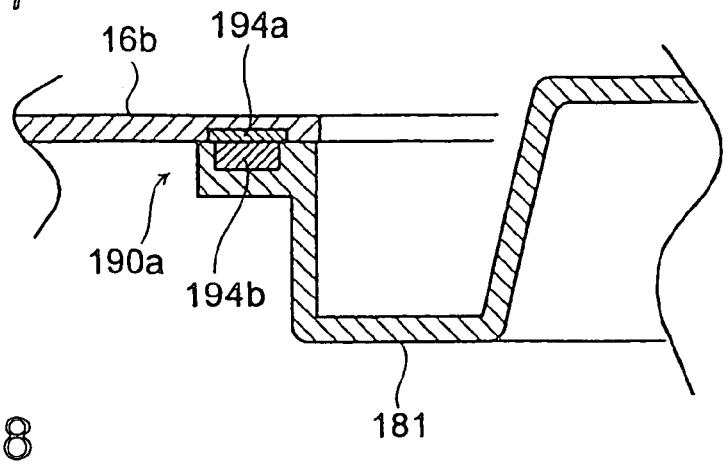
FIG. 17 is a vertical sectional view showing the coupling means with a different structure provided between the lid and the tray.

The coupling means between the rear lid 16*b* and the tray 181 may be structured as shown in FIG. 17. The coupling means 190*a* shown in FIG. 17 is composed of a pair of attracting means 194*a* and 194*b* fitted respectively on the rear lid 16*b* and the tray 181. One of the attracting means 194*a* and 194*b* is formed out of a magnet and the other is made of a magnetic material such as iron. Alternatively, both may be formed out of a magnet. The attracting force of the attracting means 194*a* and 194*b* is so set that the tray 181 follows as the rear lid 16*b* is raised but not after the tray 181 collides with the partial washing apparatus 100.

Figure 18:
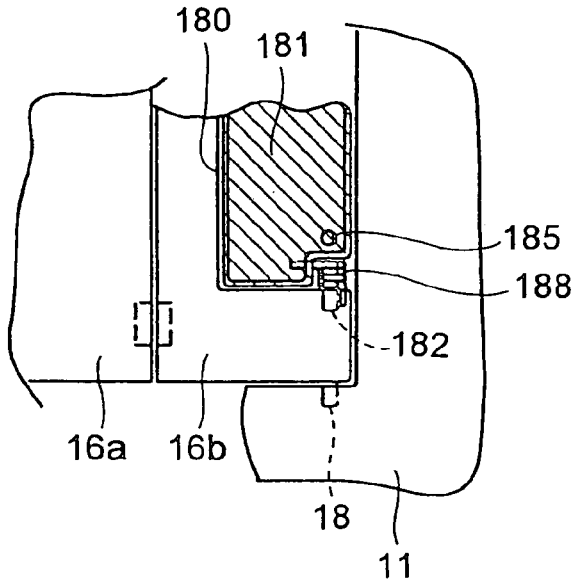
FIG. 18 is a top view showing the mechanism for pressing, with a spring, the tray toward a position in which it closes the gate opening of the lid.
Figure 19:
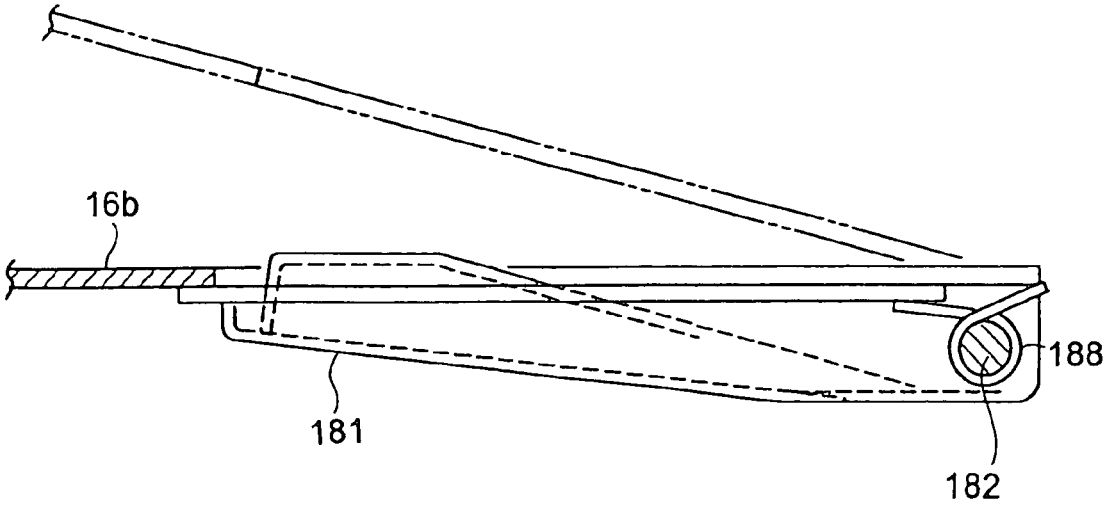
FIG. 19 is a vertical sectional view of the mechanism shown in FIG. 18.

Instead of providing coupling means, the tray 181 may be so structured as to follow the rear lid 16*b* under the force exerted by a spring. FIGS. 18 and 19 show such a structure. A torsion coil spring 188 is wound around the shafts 182 on which the tray 181 is hinged to the rear lid 16*b*. One end of the torsion coil spring 188 engages with the tray 181, and the other end engages with the rear lid 16*b*, with the result that the tray 181 is pressed toward a position in which it closes the gate opening 180. Thus, as the rear lid 16*b* is opened and closed, the tray 181 is opened and closed together. However, after the tray 181 collides with he partial washing apparatus 100, it is kept in that position. The tray 181 may be pressed with a spring of any other type than a torsion coil spring, for example a compression coil spring or tension coil spring.

In a case where the tray 181 is pressed with a spring, some means is necessary for preventing the stage 184 and the vibration horn 114 from coming into close contact and eliminating the gap through which to pass a piece of laundry. Such means can be achieved by forming projections on one or both of the tray 181 and the partial washing apparatus 100 so that the projections formed on one of them touch the surface of the other and thereby secure a predetermined gap between them. These projections are arranged where they do not hinder the passage of laundry.

The coupling means may be of a solenoid type. Specifically, a solenoid similar to that used in the locking means 200 is fitted on one of the rear lid 16*b* and the tray 181, and a hole with which to engage the plunger of the solenoid is formed in the other of them. The solenoid is controlled by the controller 80 in the following manner. While the position detecting means 170 is detecting that the partial washing apparatus 100 is in the non-use position, the solenoid keeps the rear lid 16*b* and the tray 181 in a coupled state. When the position detecting means 170 detects that the partial washing apparatus 100 has moved to the use position, the solenoid decouples the rear lid 16*b* from the tray 181 so that the tray 181 is left at the rim of the laundry entrance 15. After completion of partial washing, when the partial washing apparatus 100 has returned to the non-use position and the lid 16 is closed the controller 80, on receiving a signal from the lid state detecting means 210, changes the energization state of the solenoid so that the rear lid 16*b* and the tray 181 are coupled together again.

The tray 181 may be supported by the top plate 11 instead of by the rear lid 16*b*. Specifically, brackets are formed on the top plate 11, and the shafts 182 of the tray 181 are engaged with those brackets. Here also, aligning the axis of the shafts 182 with that of the shaft 18 helps avoid awkward movement.

In the above descriptions, the partial washing apparatus 100 is rotated with the lid 16 closed. This is because, if the lid 16 is open, the tip of the partial washing apparatus 100 collides with the hinged-end portion of the lid 16 (i.e. the hinged-end portion of the rear lid 16*b*) when the partial washing apparatus 100 is moved from the non-use position to the use position or in the opposite direction. However, it is also possible to permit the partial washing apparatus 100 to be rotated without interference with lid 16 even when the lid 16 is open by appropriately determining dimensional factors such as the width of the gate opening 180, the length (rotation radius) of the partial washing apparatus 100, and the position of the rotation center of the partial washing apparatus 100.

The partial washing apparatus 100 may be designed to be of a fixed type. Specifically, the partial washing apparatus 100 is fixed in a position where the washing portion 110 faces the laundry entrance 15 from outside the main unit 2A. This makes it possible to abolish the components that are provided to make the partial washing apparatus 100 movable, such as the position detecting means 170 of the partial washing apparatus 100 and the coupling means 190 between the rear lid 16*b* and the tray 181. In this structure, the tray detecting means 131 starts detection when the on/off button 126 of the partial washing apparatus 100 is pressed. It ends detection in a predetermined short period, just as with the movable partial washing apparatus 100. When the presence of the tray 181 is detected, the partial washing apparatus 100 immediately starts operating; when the presence of the tray 181 is not detected, the partial washing apparatus 100 is inhibited from being operated, and the operation status indicating means 128, by being blinked or lit with a different color, informs the user of the fault.

Figure 20:
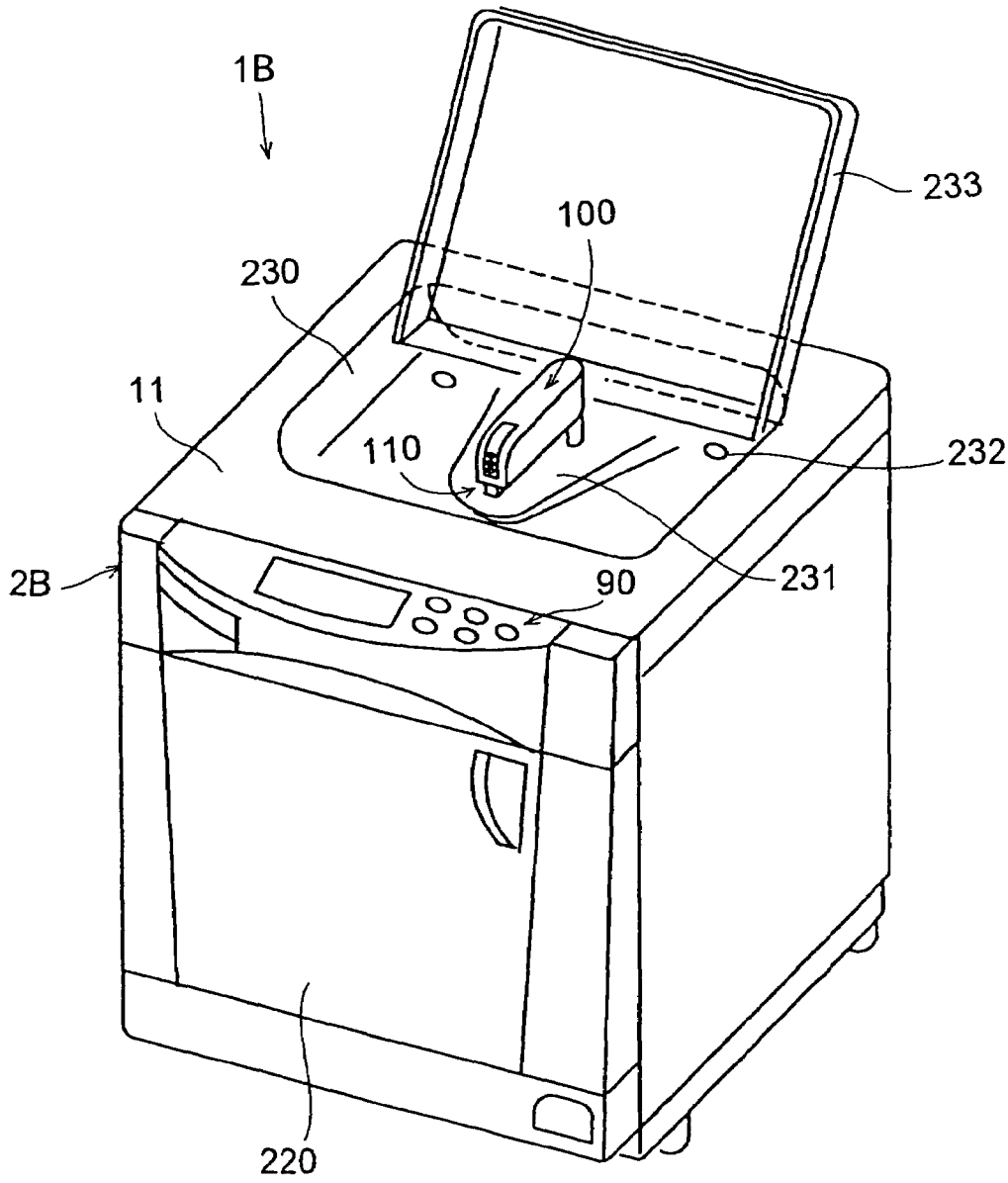
FIG. 20 is a perspective view showing the washing machine of a second embodiment of the invention.

FIG. 20 shows the washing machine of a second embodiment of the present invention. The washing machine 1B shown here incorporates a so-called tumbler-type washing tub that rotates about a horizontal axis. A door 220 is provided in the front face of a main unit 2B, and laundry is put in the washing tub (not shown) with the door 200 open. An operation panel 90 is provided in a front portion of the top face of the main unit 2B, just as in the washing machine 1A of the first embodiment.

In the washing machine 1B of the second embodiment, a sink 230 is formed in a top plate 11 of the main unit 2B, and a partial washing apparatus 100 is arranged in the sink 230. The partial washing apparatus 100 is of a fixed type. On the bottom surface of the sink 230, a stage 231 is formed so as to face the partial washing apparatus 100, and drain outlets 232 are formed in the lowest portions thereof on both sides of the stage 231. A lid 233 that can be opened and closed freely is provided so as to cover the sink 230 including the partial washing apparatus 100. In the washing machine 1B structured in this way, it is possible to perform ordinary washing inside the main unit 2B and concurrently perform partial washing by using the partial washing apparatus 100.

It is to be understood that the embodiments of the present invention described hereinbefore are mere examples of structures according to the invention; that is, the invention may be carried out in any other manner than specifically described above, and, in implementing the invention, various modifications are possible within the scope of the invention.

INDUSTRIAL APPLICABILITY

As described above, the present invention provides means for partially and powerfully washing heavily dirtied parts of laundry in a washing machine for washing clothes and other articles of cloth, and is thus very useful in improving hygiene in everyday life.

The invention claimed is:

1. A washing machine, comprising:

a partial washing apparatus movable between a use position in which the partial washing apparatus is placed when in use and a non-use position in which the partial washing apparatus is placed when not in use; and position detecting means for detecting a position of the partially washing apparatus, wherein operation of the washing machine is controlled according to the position of the partial washing apparatus as detected by the position detecting means.

2. A washing machine as claimed in claim 1, further comprising:

a main body having a washing tub housed therein;

a top plate laid on a top face of the main body and having a laundry entrance formed therein to permit laundry to be put therethrough in the washing tub;

a lid covering the laundry entrance;

a back panel laid on the top plate so as to be located in a rear side of the main body and having a connection pipe arranged therein for supplying water; and an operation panel provided in a front portion of a top surface of the top plate, wherein, the partial washing apparatus is fitted to the back panel.

3. A washing machine, comprising:

a partial washing a apparatus movable between a use position in which the partial washing apparatus is placed when in use and a non-use position in which the partial washing apparatus is placed when not in use; and position detecting means for detecting a position of the partial washing apparatus, wherein, a laundry entrance through which to put laundry in a washing tub is formed in a top face of a main unit, a lid for openably closing the laundry entrance is provided, locking means for locking the lid is provided, and the locking means is controlled according to the position of the partial washing apparatus as detected by the position detecting means.

4. A washing machine, comprising:

a main body having a washing tub housed therein;

a laundry entrance formed in a top face of the main body so as to permit laundry to be put therethrough in the washing tub;

a lid covering the laundry entrance; and a partial washing apparatus fitted on an external surface of the main body so as to be located above the lid, the partial washing apparatus being movable between a use position in which the partial washing apparatus is placed when in use and a non-use position in which the partial washing apparatus is placed when not in use, and wherein even if the lid is opened or closed with the partial washing apparatus in the non-use position, the lid and the partial washing apparatus do not interfere with each other.

5. A washing machine as claimed in claim 4, wherein the lid can be opened with a washing portion of the partial washing apparatus located in a position in which the washing portion faces the laundry entrance.

6. A washing machine as claimed in claim 5, wherein the lid is hinged to the main unit so as to be rotatable in a vertical plane, and a gate opening through which to let the partial washing apparatus pass is formed in the lid so that the lid can be opened with the washing portion of the partial washing apparatus located in the position in which the washing portion faces the laundry entrance.

7. A washing machine as claimed in claim 6, wherein the partial washing apparatus is combined with a tray for sustaining a piece of laundry, the tray being so shaped as to partially or completely close the gate opening.

8. A washing machine, comprising:

a partial washing apparatus movable between a use position in which the partial washing apparatus is placed when in use and a non-use position in which the partial washing apparatus is placed when not in use, the partial washing apparatus being combined with a tray for receiving laundry; and a drain outlet provided in a bottom surface of the tray, wherein tray detecting means for detecting presence of the tray is provided.

9. A washing machine as claimed in claim 8, wherein the tray detecting means is provided in the partial washing apparatus.

10. A washing machine as claimed in claim 8, wherein operation of the partial washing apparatus is controlled according to a result of detection by the tray detecting means.

11. A washing machine, comprising:

a partial washing apparatus movable between a use position in which the partial washing apparatus is placed when in use and a non-use position in which the partial washing apparatus is placed when not in use, the partial washing apparatus being combined with a tray for receiving laundry; and a drain outlet provided in a bottom surface of the tray, wherein a laundry entrance through which to put laundry in the washing tub is formed in a top face of the main unit, and a lid for closing the laundry entrance is provided, the lid being so designed that when the partial washing apparatus is in the non-use position, as the lid is opened and closed, the tray is opened and closed together, and when the partial washing apparatus is in the use position, the lid alone is opened and closed.

12. A washing machine, comprising:

a partial washing apparatus fitted on an outer surface of a main unit having a washing tub housed therein, the partial washing apparatus rotatable in a horizontal plane between a use position where the partial washing apparatus is placed when in use and a non-use position where the partial washing apparatus is placed when not in use;

locking means for keeping the partial washing apparatus in the non-use or use position is provided;

a laundry entrance though which to put laundry in a washing tub is formed in a top face of a main unit;

lid state detecting means for detecting an open/closed state of a lid covering the laundry entrance is provided, and wherein the locking means locks rotation of the partial washing apparatus when the lid state detecting means detects that the lid is open with the partial washing apparatus in the non-use or use position.

* * * * *